US009708867B2

(12) United States Patent
Lovell et al.

(10) Patent No.: US 9,708,867 B2
(45) **Date of Patent: *Jul. 18, 2017**

(54) SYSTEM AND METHODS USING FIBER OPTICS IN COILED TUBING

(75) Inventors: John R. Lovell, Houston, TX (US); Michael G. Gay, Dickinson, TX (US); Sarmad Adnan, Sugar Land, TX (US); Kean Zemlak, Edmonton (CA)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/575,024

(22) Filed: Oct. 7, 2009

(65) Prior Publication Data

US 2010/0018703 A1 Jan. 28, 2010

Related U.S. Application Data

(63) Continuation of application No. 11/135,314, filed on May 23, 2005, now Pat. No. 7,617,873.

(Continued)

(51) Int. Cl.
*E21B 17/20* (2006.01)
*E21B 47/12* (2012.01)

(52) U.S. Cl.
CPC ..... *E21B 17/206* (2013.01); *E21B 47/123* (2013.01)

(58) Field of Classification Search
CPC ..... E21B 43/00; E21B 43/16

(Continued)

(56) References Cited

U.S. PATENT DOCUMENTS 2,558,427 A 6/1951 Fagan et al.
2,651,027 A 9/1953 Vogel (Continued)

FOREIGN PATENT DOCUMENTS

DE 2818656 10/1979
DE 29816469 12/1998

(Continued)

OTHER PUBLICATIONS

D.A Khron; Fiber Optic Sensors: Fundamentals and Applications; 2000; ISBN No. 1556177143.

(Continued)

*Primary Examiner* — Shane Bomar
(74) *Attorney, Agent, or Firm* — Michael L. Flynn; Jody Lynn DeStefanis; Robin Nava

(57) ABSTRACT

Apparatus having a fiber optic tether disposed in coiled tubing for communicating information between downhole tools and sensors and surface equipment and methods of operating such equipment. Wellbore operations performed using the fiber optic enabled coiled tubing apparatus includes transmitting control signals from the surface equipment to the downhole equipment over the fiber optic tether, transmitting information gathered from at least one downhole sensor to the surface equipment over the fiber optic tether, or collecting information by measuring an optical property observed on the fiber optic tether. The downhole tools or sensors connected to the fiber optic tether may either include devices that manipulate or respond to optical signal directly or tools or sensors that operate according to conventional principles.

22 Claims, 5 Drawing Sheets

Related U.S. Application Data

(60) Provisional application No. 60/575,327, filed on May 28, 2004.

(58) Field of Classification Search
USPC ..... 166/250.01, 250.02, 250.05, 250.07, 166/250.08, 250.1, 279, 305.1
See application file for complete search history.

(56) References Cited

U.S. PATENT DOCUMENTS 3,348,616 A 10/1967 Zingg
4,619,323 A 10/1986 Gidley
4,856,584 A 8/1989 Seidner
4,859,054 A 8/1989 Harrison
4,904,865 A 2/1990 Meisner et al.
4,926,940 A 5/1990 Stromswold
5,042,903 A 8/1991 Jakubowski
5,284,207 A 2/1994 Bittleston et al.
5,320,181 A 6/1994 Lantier et al.
5,332,048 A 7/1994 Underwood et al.
5,419,395 A 5/1995 Harvey et al.
5,434,395 A 7/1995 Storck et al.
5,485,745 A * 1/1996 Rademaker et al. ..... 73/152.39
5,542,471 A 8/1996 Dickinson
5,573,225 A 11/1996 Boyle et al.
5,597,042 A 1/1997 Tubel et al.
5,810,080 A 9/1998 Meynier
5,898,517 A * 4/1999 Weis ..... 356/5.09
5,944,123 A 8/1999 Johnson
5,965,826 A 10/1999 Bertrab
5,992,250 A 11/1999 Kluth et al.
5,996,689 A 12/1999 Head
6,009,216 A 12/1999 Pruett et al.
6,062,311 A 5/2000 Johnson et al.
6,079,281 A 6/2000 Oszajca et al.
6,082,461 A 7/2000 Newman et al.
6,089,323 A 7/2000 Newman et al.
6,112,809 A 9/2000 Angel
6,157,893 A 12/2000 Berger et al.
6,173,771 B1 1/2001 Eslinger et al.
6,173,795 B1 1/2001 McGarian et al.
6,192,983 B1 2/2001 Neuroth et al.
6,241,031 B1 6/2001 Beaufort et al.
6,247,536 B1 6/2001 Leismer et al.
6,268,911 B1 * 7/2001 Tubel et al. ..... 356/72
6,273,189 B1 8/2001 Gissler et al.
6,276,454 B1 8/2001 Fontana et al.
6,281,489 B1 8/2001 Tubel et al.
6,321,845 B1 11/2001 Deaton
6,323,420 B1 11/2001 Head
6,347,674 B1 2/2002 Bloom
6,349,768 B1 2/2002 Leising
6,367,366 B1 4/2002 Bloom et al.
6,392,151 B1 5/2002 Rafie et al.
6,397,864 B1 6/2002 Johnson
6,419,014 B1 7/2002 Meek et al.
6,427,786 B2 8/2002 Beaufort et al.
6,464,003 B2 10/2002 Bloom
6,467,557 B1 10/2002 Krueger
6,474,152 B1 11/2002 Mullins et al.
6,478,097 B2 11/2002 Bloom
6,497,290 B1 12/2002 Misselbrook et al.
6,519,568 B1 2/2003 Harvey et al.
6,531,694 B2 * 3/2003 Tubel et al. ..... 250/227.14
6,534,449 B1 3/2003 Gilmour et al.
6,581,455 B1 6/2003 Berger et al.
6,629,568 B2 10/2003 Post et al.
6,640,894 B2 11/2003 Bloom
6,644,402 B1 * 11/2003 Sharma et al. ..... 166/250.01
6,655,461 B2 12/2003 Eslinger et al.
6,667,280 B2 12/2003 Chang et al.
6,679,341 B2 1/2004 Bloom
6,691,587 B1 2/2004 King
6,715,559 B2 4/2004 Bloom
6,745,854 B2 6/2004 Bloom
6,789,621 B2 9/2004 Wetzel et al.
6,817,410 B2 11/2004 Wetzel et al.
6,834,722 B2 12/2004 Vacik et al.
6,868,906 B1 3/2005 Vail
6,889,771 B1 5/2005 Leising et al.
6,935,423 B2 8/2005 Kusmer
6,938,708 B2 9/2005 Bloom
7,048,047 B2 5/2006 Bloom
7,055,604 B2 6/2006 Jee et al.
7,073,582 B2 7/2006 Connell et al.
7,077,200 B1 7/2006 Adnan et al.
7,080,701 B2 7/2006 Bloom
7,121,364 B2 10/2006 Mock
7,124,819 B2 10/2006 Ciglenec et al.
7,140,435 B2 11/2006 Defretin et al.
7,140,437 B2 * 11/2006 McMechan et al. ..... 166/278
7,152,685 B2 12/2006 Adnan et al.
7,174,974 B2 2/2007 Bloom
7,182,134 B2 2/2007 Wetzel et al.
7,207,216 B2 4/2007 Meister et al.
7,308,941 B2 12/2007 Rolovic et al.
7,311,153 B2 12/2007 McKee et al.
7,515,774 B2 4/2009 Vannuffelen et al.
7,565,834 B2 7/2009 Adnan et al.
7,597,142 B2 10/2009 Hartog et al.
7,614,452 B2 11/2009 Kenison et al.
7,617,873 B2 * 11/2009 Lovell et al. ..... 166/305.1
7,654,318 B2 2/2010 Cooper et al.
7,757,755 B2 7/2010 Kenison et al.
7,793,732 B2 9/2010 Xu et al.
7,827,859 B2 11/2010 Pipchuk et al.
7,841,412 B2 11/2010 Jasser et al.
7,929,812 B2 4/2011 Vannuffelen et al.
8,230,915 B2 7/2012 Weng
8,733,438 B2 5/2014 Kenison et al.
8,770,303 B2 7/2014 Aguirra et al.
8,844,653 B2 9/2014 Deboer
2001/0050172 A1 * 12/2001 Tolman et al. ..... 166/297
2002/0007945 A1 1/2002 Neuroth et al.
2002/0007948 A1 * 1/2002 Bayne ..... E21B 17/003 166/278
2002/0017386 A1 * 2/2002 Ringgenberg et al. .. 166/250.17
2002/0029908 A1 3/2002 Bloom
2002/0104686 A1 8/2002 Bloom
2002/0125008 A1 9/2002 Wetzel et al.
2003/0075361 A1 4/2003 Terry et al.
2003/0116356 A1 6/2003 Bloom
2003/0121703 A1 7/2003 Bloom
2003/0155156 A1 8/2003 Livingstone
2003/0188875 A1 10/2003 Bloom
2004/0020653 A1 2/2004 Smith
2004/0040707 A1 * 3/2004 Dusterhoft et al. ..... 166/279
2004/0045705 A1 3/2004 Gardner et al.
2004/0067002 A1 4/2004 Berg et al.
2004/0084190 A1 5/2004 Hill et al.
2004/0104052 A1 6/2004 Livingstone
2004/0129418 A1 7/2004 Jee et al.
2004/0245018 A1 12/2004 Bloom
2005/0016730 A1 1/2005 McMechan et al.
2005/0072577 A1 4/2005 Freeman
2005/0082055 A1 4/2005 Bloom et al.
2005/0126777 A1 6/2005 Rolovic et al.
2005/0145415 A1 7/2005 Doering et al.
2005/0236161 A1 10/2005 Gay et al.
2005/0247488 A1 11/2005 Mock
2005/0252686 A1 11/2005 Bloom
2006/0044156 A1 3/2006 Adnan et al.
2006/0102347 A1 5/2006 Smith
2006/0152383 A1 7/2006 Yamate et al.
2006/0157239 A1 7/2006 Ramos et al.
2006/0196694 A1 9/2006 Bloom
2006/0196696 A1 9/2006 Bloom
2007/0126594 A1 6/2007 Atkinson et al.
2007/0137860 A1 6/2007 Lovell et al.
2007/0215345 A1 9/2007 Lafferty et al.
2007/0227741 A1 10/2007 Lovell et al.
2008/0041594 A1 2/2008 Boles et al.
2008/0053658 A1 3/2008 Wesson et al.
2008/0066962 A1 3/2008 Rolovic et al.

(56) References Cited

U.S. PATENT DOCUMENTS

| | | | |
|---|---|---|---|
| 2008/0066963 | A1 | 3/2008 | Sheiretov et al. |
| 2008/0134774 | A1 | 6/2008 | Oddie |
| 2008/0210427 | A1 | 9/2008 | Ziauddin et al. |
| 2008/0308272 | A1 | 12/2008 | Thomeer et al. |
| 2009/0025923 | A1 | 1/2009 | Patel et al. |
| 2009/0151936 | A1 | 6/2009 | Greenaway |
| 2011/0155379 | A1 | 6/2011 | Bailey et al. |

FOREIGN PATENT DOCUMENTS

| | | | |
|---|---|---|---|
| EP | 0203249 | | 12/1986 |
| EP | 0853249 | | 7/1998 |
| EP | 911483 | B1 | 8/2006 |
| GB | 2177231 | | 1/1987 |
| GB | 2275953 | | 9/1994 |
| GB | 2299868 | | 10/1996 |
| GB | 2346908 | | 8/2000 |
| GB | 2362405 | | 11/2001 |
| GB | 2378468 | | 2/2003 |
| GB | 2378469 | | 2/2003 |
| GB | 2413816 | | 11/2005 |
| GB | 2434819 | | 8/2007 |
| SU | 1236098 | A1 | 6/1986 |
| WO | 95/21987 | | 8/1995 |
| WO | 97/08418 | | 3/1997 |
| WO | 00/36266 | | 6/2000 |
| WO | 00/46481 | | 8/2000 |
| WO | 01/09478 | | 2/2001 |
| WO | 02/44509 | | 6/2002 |
| WO | 2004072433 | | 8/2004 |
| WO | 2008024859 | | 2/2008 |
| WO | 2008081404 | | 7/2008 |

OTHER PUBLICATIONS

B. Stoop; Photonic Analog-to-Digital Conversion; Spring Series in Optical Sciences, ISBN No. 3540413448; Published by Springer-Verlag in 2001.

O.S. Wolfbeis, L. Weis, M.J.P. Leiner and W.E. Ziegler; Fiber Optic Fluorosensor for Oxygen and Carbon Dioxide; Anal. Chem.; 1998; vol. 60; pp. 2028-2030.

M.H. Maher and M.R. Shahriari; A Fiber Optic Chemical Sensor for Measurement of Groundwater pH; The American Society for Testing and Materials; Sep. 1993; pp. 448-452; vol. 21 No. 5; Rutgers University, Piscataway, NJ.

O. Esteban, M. Curz-Navarrete, N. Lez-Cano, and E. Bernabeu; Measurement of the Degree of Salinity of Water With a Fiber-Optic Sensor; Sep. 1999; Applied Optics; vol. 38, Issue 25; pp. 5267-5271.

Eslinger et al., "A Hybrid Milling/Jetting Tool—The Safe Solution to Scale Milling", SPE 60700, Society of Petroleum Engineers, Inc., Houston, Texas, Apr. 5-6, 2000, 6 pages.

Johnson et al., "An Abrasive Jetting Scale Removal System", SPE 46026, Society of Petroleum Engineers, Inc., Houston, Texas, Apr. 15-16, 1996, 6 pages.

Office Action issued in U.S. Appl. No. 13/645,963 on Apr. 13, 2017; 16 pages.

* cited by examiner

SYSTEM AND METHODS USING FIBER OPTICS IN COILED TUBING

CROSS-REFERENCE TO RELATED APPLICATIONS

The present document is a continuation of prior co-pending U.S. patent application Ser. No. 11/135,314, filed on May 23, 2005, which in turn claims priority under 35 U.S.C. §119(e) to U.S. Provisional Application Ser. No. 60/575,327 filed May 28, 2004.

FIELD OF THE INVENTION

The present invention relates generally to subterranean well operations, and more particularly to the use of fiber optics and fiber optic components such as tethers and sensors in coiled tubing operations.

BACKGROUND OF THE INVENTION

During the life of a subterranean well such as those drilled in oilfields, it is often necessary or desirable to perform services on the well to, for example, extend the life of the well, improve production, access a subterranean zone, or remedy a condition that has occurred during operations. Coiled tubing is known to be useful to perform such services. Using coiled tubing often is quicker and more economic than using jointed pipe and a rig to perform services on a well, and coiled tubing permits conveyance into non-vertical or multi-branched wellbores.

While coiled tubing operations perform some action deep in the subsurface of the earth, personnel or equipment at the surface control the operations. There is however a general lack of information at the surface as to the status of downhole coiled tubing operations. When no clear data transfer is possible between the downhole tool and the surface, it is not always possible to know what the wellbore condition is or what state a tool is in.

Coiled tubing is particularly useful for well treatments involving fluids, with one or more fluids being pumped into the wellbore through the hollow core of coiled tubing or down the annulus between the coiled tubing and the wellbore. Such treatments may include circulating the well, cleaning fill, stimulating the reservoir, removing scale, fracturing, isolating zones, etc. The coiled tubing permits placement of those fluids at a particular depth in a wellbore. Coiled tubing may also be used to intervene in a wellbore to permit, for example, fishing for lost equipment or placement or manipulation of equipment in the wellbore.

In deploying coiled tubing under pressure into a wellbore, the continuous length of coiled tubing passes through from the reel through wellhead seals and into the wellbore. Fluid flow through coiled tubing also may be used to provide hydraulic power to a toolstring attached to the end of the coiled tubing. A typical toolstring may include one or more non-return valves so that if the tubing breaks, the non-return valves close and prevent escape of well fluids. Because of the flow requirements, typically there is no system for direct data communication between the toolstring and the surface. Other devices used with coiled tubing may be triggered hydraulically. Some devices such as running tools can be triggered by a sequence of pulling and pushing the toolstring, but again it is difficult for the surface operator to know the downhole tool status.

Similarly, it is important to be able to accurately estimate the depth of a toolstring in a wellbore. Direct measurement of the length of coiled tubing attached to a tool string and injected into a wellbore may not accurately represent the toolstring depth however as coiled tubing is subject to helical coiling as it is fed down the well casing. This helical coiling effect makes estimating depth of the tool deployed on coiled tubing unpredictable.

The difficulty in gathering and conveying accurate data from deep in the subsurface to the surface often results in an incorrect representation of the downhole conditions to personnel that are making decisions in regard to the downhole operations. It is desirable to have information regarding the wellbore operations conveyed to the surface, and it is particularly desirable that the information be conveyed in real-time to permit the operations to be adjusted. This would enhance the efficiency and lower the cost of wellbore operations. For example, the availability of such information would permit personnel to better operate a toolstring placed in a wellbore, to more accurately determine the position of the toolstring, or to confirm the proper execution of wellbore operations.

There are known methods for transferring data from wellbore operation to the surface such as using fluid pulses and wireline cables. Each of these methods has distinct disadvantages. Mud pulse telemetry uses fluid pulses to transmit a modulated pressure wave at the surface. This wave is then demodulated to retrieve the transmitted bits. This telemetry method can provide data at a small number of bits per second but at higher data rates, the signal is heavily attenuated by the fluid properties. Furthermore, the manner in which mud-pulse telemetry creates its signal implicitly requires a temporary obstruction in the flow; this often is undesirable in well operations.

It is known to use electrical or wireline cables with coiled tubing to transmit information during wellbore operations. It has been suggested, as in U.S. Pat. No. 5,434,395, to deploy a wireline cable with coiled tubing, the cable being deployed exterior to the coiled tubing. Such an exterior deployment is operationally difficult and risks interference with wellbore completions. The need for specialized equipment and procedures and the likelihood that the cable would wrap around the coiled tubing as it is deployed makes such a method undesirable. Another technique, such as taught by U.S. Pat. No. 5,542,471 relies upon embedding cable or data channels within the wall thickness of the coiled tubing itself. Such a configuration has the advantage that the full inner diameter of the coiled tubing can be used for pumping fluids, but also has the significant disadvantage that there is no convenient way to repair such coiled tubing in the field. It is not uncommon during coiled tubing operations for the coiled tubing to become damaged, in which case the damaged section needs to be removed from the coil and the remaining pieces welded back together. In the presence of embedded cables or data channels, such welding operations can be complicated or simply unachievable.

It is known to deploy wireline cable within coiled tubing. Although this method provides certain functionality, it also has disadvantages. Firstly, introducing cable into the coiled-tubing reel is non-trivial. Fluid is used to transport the wireline cable into the tubing, and a large, high-pressure capstan is needed to move the cable along with the fluid. U.S. Pat. No. 5,573,225 entitled Means For Placing Cable Within Coiled Tubing, to Bruce W. Boyle, et al., incorporated by reference, describes one such apparatus for installing electrical cable into coiled tubing Beyond the difficulty of installing a cable into coiled tubing, the relative size of the cable with respect to the inner diameter of the coiled tubing as well as the weight and the cost of the cable, discourage the use of cable within coiled tubing.

Electrical cables used in coiled tubing operations are commonly 0.25 to 0.3 inches (0.635 to 0.762 cm) in diameter while coiled tubing inner diameters generally range from 1 to 2.5 inches (2.54 to 6.350 cm). The relatively large exterior diameter of the cable compared to the relatively small inner diameter of the coiled tubing undesirably reduces the cross-sectional area available for fluid flow in the tube. In addition, the large exterior surface area of the cable provides frictional resistance to fluid pumped through the coiled tubing.

The weight of wireline cable provides yet another drawback to its use in coiled tubing. Known electrical cables used in oilfield coiled tubing operations can weigh up to 0.35 lb/ft (2.91 kg/m) such that a 20,000 ft (6096 cm) length of electrical cable could add an additional 7,000 lb (3175 kg) to the weight of the coiled tubing string. In comparison, typical 1.25 in (3.175 cm) coiled tubing string would weigh approximately 1.5 lb/ft (12.5 kg/m) with a resulting weight of 30,000 lb (13608 Kg) for a 20,000 ft (6096 cm) string. Consequently, the electric cable increases the system weight by around 25%. Such heavy equipment is difficult to manipulate and often prevents installation of the wireline equipped coiled tubing in the field. Moreover, the heaviness of the cable will cause it to stretch under its own weight at a rate different from the stretch of the tubular, which results in the introduction of slack in the cable. The slack must be managed to avoid breakage and tangling ("birdnesting") of the cable in the coiled tubing. Managing the slack, including in some cases trimming the cable or cutting back the coiled tubing string to give sufficient cable slack, can add operational time and expense to the coiled tubing operation.

There are other difficulties with using a wireline cable inside coiled tubing for data transmission. For example, to retrieve the data off the transmission line in the cable, a data collector is needed that can rotate with the reel while simultaneously not tangling up that part of the wire which is outside the reel (e.g., that wire that is connected to a surface computer). Such known devices are failure prone and expensive. In addition, the cable itself is subject to wear and degradation owing to the flow of fluids in the coiled tubing. The exterior armor of the cable armor can create operational difficulties as well. In some well operations, the coiled tubing is sheared to seal the wellbore as soon as possible. Shears optimized to cut through coiled tubing however typically are not efficient at cutting through the armored cable.

From the foregoing, it will be apparent that the need exists for systems and methods to gather and convey data to and from wellbore operations using coiled tubing to the surface without encumber the wellbore operations. Systems and methods to gather and convey this information in a timely, efficient and cost effective manner are particularly desirable. The present invention overcomes the deficiencies in the prior art and addresses these needs.

SUMMARY OF THE INVENTION

The present invention provides systems, apparatus and methods of working in a wellbore or for performing borehole operations or well treatments comprising deploying a fiber optic tether in a coiled tubing, deploying the coiled tubing into a wellbore, and conveying borehole information using the fiber optic tether.

In an embodiment, the present invention provides a method of treating a subterranean formation intersected by a wellbore comprising deploying a fiber optic tether into a coiled tubing, deploying the coiled tubing into the wellbore, performing a well treatment operation, measuring a property in the wellbore, and using the fiber optic tether to convey the measured property. The well treatment operation may comprise at least one adjustable parameter and the method may include adjusting the parameter. The method is particularly desirable when the property is measured as a well treatment operation is performed, when a parameter of the well treatment operation is being adjusted or when the measurement and the conveying of the measured property are performed in real time. Often the well treatment operation will involve injecting at least one fluid into the wellbore, such as injecting a fluid into the coiled tubing, into the wellbore annulus, or both. In some operations, more than one fluid may be injected or different fluids may be injected into the coiled tubing and the annulus. The well treatment operation may comprise providing fluids to stimulate hydrocarbon flow or to impede water flow from a subterranean formation. In some embodiments, the well treatment operation may include communicating via the fiber optic tether with a tool in the wellbore, and in particular communicating from surface equipment to a tool in the wellbore. The measured property may be any property that may be measured downhole, including but not limited to pressure, temperature, pH, amount of precipitate, fluid temperature, depth, presence of gas, chemical luminescence, gamma-ray, resistivity, salinity, fluid flow, fluid compressibility, tool location, presence of a casing collar locator, tool state and tool orientation. In particular embodiments, the measured property may be a distributed range of measurements across an interval of a wellbore such as across a branch of a multi-lateral well. The parameter of the well treatment operation may be any parameter that may be adjusted, including but not limited to quantity of injection fluid, relative propositions of each fluid in a set of injected fluids, the chemical concentration of each material in a set of injected materials, the relative proportion of fluids being pumped in the annulus to fluids being pumped in the coiled tubing, concentration of catalyst to be released, concentration of polymer, concentration of proppant, and location of coiled tubing. The method may further involve retracting the coiled tubing from the wellbore or leaving the fiber optic tether in the wellbore.

In an embodiment, the present invention relates to a method of performing an operation in a subterranean well comprising deploying a fiber optic tether into a coiled tubing, deploying the coiled tubing into the well, and performing at least one process step of transmitting control signals from a control system over the fiber optic tether to borehole equipment connected to the coiled tubing, transmitting information from borehole equipment to a control system over the fiber optic tether; or transmitting property measured by the fiber optic tether to a control system via the fiber optic tether. The method may further involve retracting the coiled tubing from the well or leaving the fiber optic tether in the well. Typically the fiber optic tether is deployed into the coiled tubing by pumping a fluid into the coiled tubing. The tether may be deployed into the coiled tubing while it is spooled or unspooled. The method may also include measuring a property. In certain embodiments, the measurement may be taken in real time. The measured property may be any property that can be measured downhole, including but not limited to bottomhole pressure, bottomhole temperature, distributed temperature, fluid resistivity, pH, compression/tension, torque, downhole fluid flow, downhole fluid compressibility, tool position, gamma-ray, tool orientation, solids bed height, and casing collar location.

The present invention provides an apparatus for performing an operation in a subterranean wellbore comprising coiled tubing adapted to be disposed in a wellbore, surface control equipment, at least one wellbore device connected to the coiled tubing, and a fiber optic tether installed in the coiled tubing and connected to each of the wellbore device and the surface control equipment, the fiber optic tether comprising at least one optical fiber whereby optical signals may be transmitted a) from the at least one wellbore device to the surface control equipment, b) from the surface control equipment to the at least one wellbore device, or c) from the at least one wellbore device to the surface control equipment and from the surface control equipment to the at least one wellbore device. In some preferred embodiments, the fiber optic tether is a metal tube with at least one optical fiber disposed therein. Surface or downhole terminations or both may be provided. The wellbore device may comprise a measurement device to measure a property and generate an output and an interface device to convert the output from the measurement device to an optical signal. The property may be any property that can be measured in a borehole including but not limited to pressure, temperature, distributed temperature, pH, amount of precipitate, fluid temperature, depth, chemical luminescence, gamma-ray, resistivity, salinity, fluid flow, fluid compressibility, viscosity, compression, stress, strain, tool location, tool state, tool orientation, and combinations thereof. In some embodiments, the apparatus of the present invention may comprise a device to enter a predetermined branch of a multi-lateral well. In particular embodiments, the wellbore may be a multilateral well and the measured property be tool orientation or tool position.

In some embodiments, the apparatus further comprises a means for adjusting the operation in response to an optical signal received by the surface equipment from the at least one wellbore device. In some embodiments, the fiber optic tether comprises more than one optical fiber, wherein optical signals may be transmitted from the surface control equipment to the at least one wellbore device on an optical fiber and optical signals may be transmitted from the at least one wellbore device to the surface control equipment on a different fiber. Types of wellbore devices include a camera, a caliper, a feeler, a casing collar locator, a sensor, a temperature sensor, a chemical sensor, a pressure sensor, a proximity sensor, a resistivity sensor, an electrical sensor, an actuator, an optically activated tool, a chemical analyzer, a flow-measuring device, a valve actuator, a firing head actuator, a tool actuator, a reversing valve, a check valve, and a fluid analyzer. The apparatus of the present invention is useful for a variety of wellbore operations, such as matrix stimulation, fill cleanout, fracturing, scale removal, zonal isolation, perforation, downhole flow control, downhole completion manipulation, well logging, fishing, drilling, milling, measuring a physical property, locating a piece of equipment in the well, locating a particular feature in a wellbore, controlling a valve, and controlling a tool.

The present invention also relates to a method of determining a property of a subterranean formation intersected by a wellbore, the method comprising deploying a fiber optic tether into a coiled tubing, deploying a measurement tool into a wellbore on the coiled tubing, measuring a property using the measurement tool, and using the fiber optic tether to convey the measured property. In some embodiments, the method may also include retracting the coiled tubing and measurement tool from the wellbore. In preferred embodiments, the property is conveyed in real time or concurrently with the performing of a well treatment operation.

In a broad sense, the present invention relates to a method of working in a wellbore comprising deploying a fiber optic tether into a coiled tubing, deploying the coiled tubing into the wellbore and performing an operation, wherein the operation is controlled by signals transmitted over the fiber optic tether, or the operation involves transmitting information from the wellbore to surface equipment or from the surface equipment to the wellbore via the fiber optic tether.

Other aspects and advantages of the present invention will become apparent from the following detailed description, taken in conjunction with the accompanying drawings, illustrating by way of example the principles of the invention.

DETAILED DESCRIPTION

Figure 1:
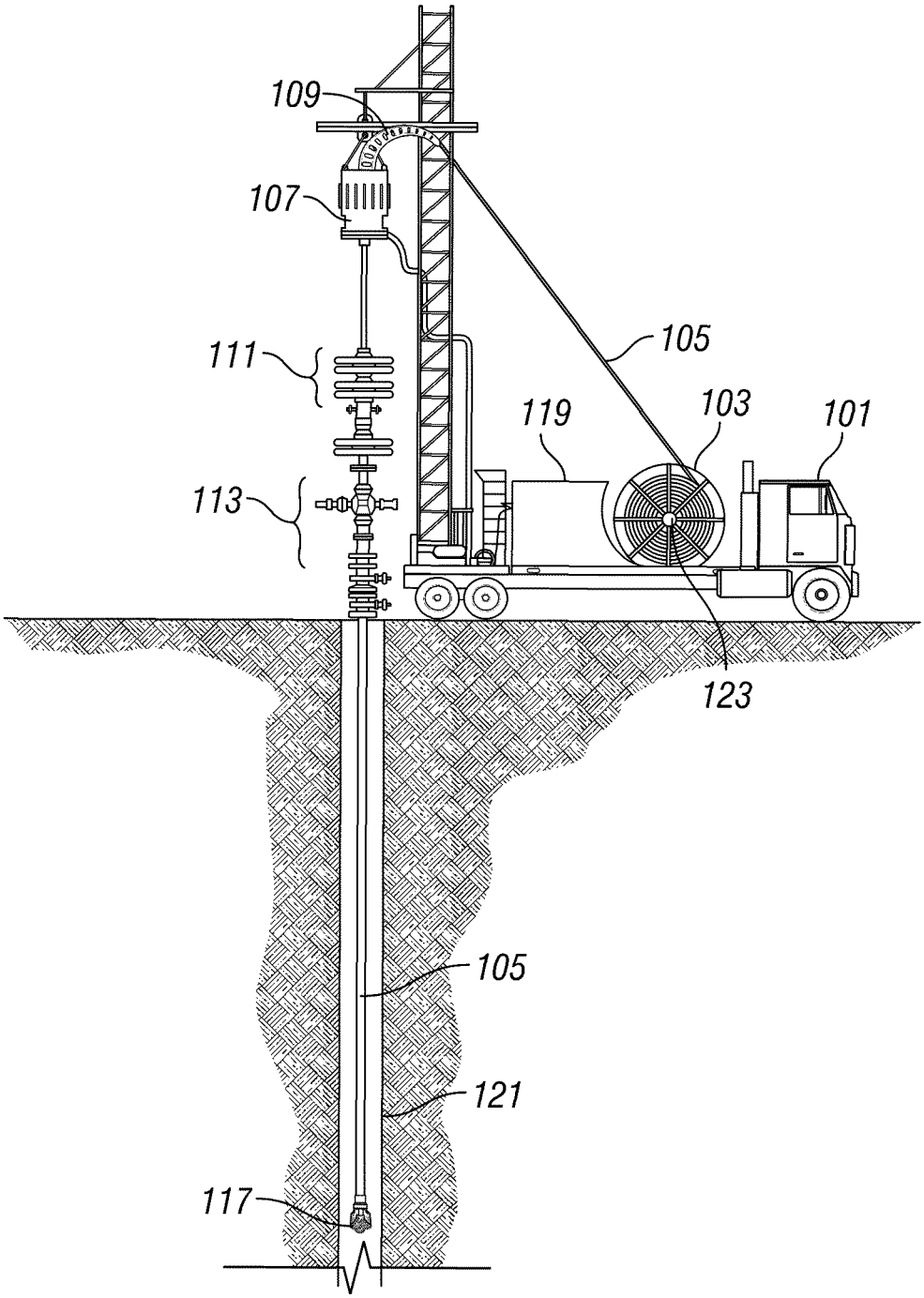
FIG. 1 is a schematic illustration of a coiled tubing (CT) equipment used for well treatment operations.

In the following detailed description and in the several figures of the drawings, like elements are identified with like reference numerals.

According to the present invention, operations such a well treatment operation may be performed in a wellbore using a coiled tubing having a fiber optic tether disposed therein, the fiber optic tether being capable of use for transmitting signals or information from the wellbore to the surface or from the surface to the wellbore. The capabilities of such a system provides many advantages over the performing such operations with prior art transmission methods and enables many hitherto unavailable uses of coiled tubing in wellbore operations. The use of optical fibers in the present invention provides advantages as to being lightweight, having small cross-section and provide high bandwidth capabilities.

Referring to FIG. 1, there is shown a schematic illustration of equipment, and in particular surface equipment, used in a providing coiled tubing services or operations using in subterranean well. The coiled tubing equipment may be provided to a well site using a truck 101, skid, or trailer. Truck 101 carries a tubing reel 103 that holds, spooled up thereon, a quantity of coiled tubing 105. One end of the coiled tubing 105 terminates at the center axis of reel 103 in a reel plumbing apparatus 123 that enables fluids to be pumped into the coiled tubing 105 while permitting the reel to rotate. The other end of coiled tubing 105 is placed into wellbore 121 by injector head 107 via gooseneck 109. Injector head 107 injects the coiled tubing 105 into wellbore 121 through the various surface well control hardware, such as blow out preventor stack 111 and master control valve 113. Coiled tubing 105 may convey one or more tools or sensors 117 at its downhole end.

Coiled tubing truck 101 may be some other mobile-coiled tubing unit or a permanently installed structure at the wellsite. The coiled tubing truck 101 (or alternative) also carries some surface control equipment 119, which typically includes a computer. Surface control equipment 119 is connected to injector head 107 and reel 103 and is used to control the injection of coiled tubing 105 into well 121. Control equipment 119 is also useful for controlling operation of tools and sensors 117 and for collecting any data transmitted to from the tools and sensors 117 to the surface. Monitoring equipment 118 may be provide together with control equipment 119 or separately. The connection between coiled tubing 105 and monitoring equipment 118 and or control equipment 119 may be a physical connection as with communication lines, or it may be a virtual connection through wireless transmission or known communications protocols such as TCP/IP. One such system for wireless communication useful with the present invention is described in U.S. patent application Ser. No. 10/926,522, incorporated herein in the entirety by reference. In this manner, it is possible for monitoring equipment 118 to be located at some distance away from the wellbore. Furthermore, the monitoring equipment 118 may in turn be used to transmit the received signals to offsite locations via methods such as described by U.S. Pat. No. 6,519,568, incorporated herein by reference.

Figure 2A:
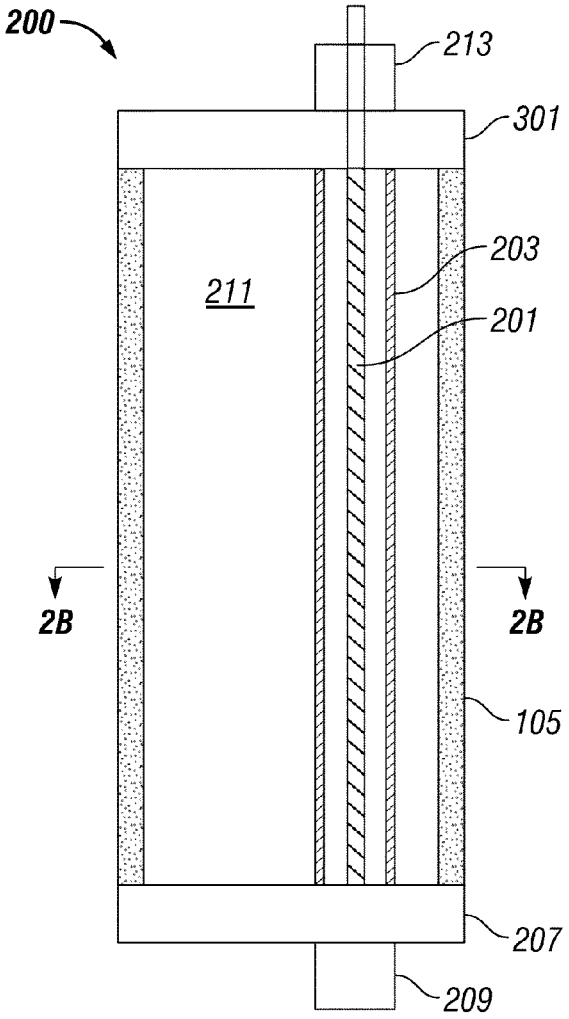
FIG. 2A is a cross-sectional view along the downhole axis of an exemplary coiled tubing apparatus using a fiber optic system in conjunction with coiled tubing operations.

Turning to FIG. 2A, there is shown a cross-sectional view of coiled tubing apparatus 200 according to the invention includes a coiled tubing string 105, a fiber optic tether 211 (comprising in the embodiment shown of an outer protective tube 203 and one or more optical fiber 201), a surface termination 301, downhole termination 207, and a surface pressure bulkhead 213. Surface pressure bulkhead 213 is mounted in coiled tubing reel 103 and is used to seal fiber optic tether 211 within coiled tubing string 105 thereby preventing release of treating fluid and pressure while providing access to optical fiber 201. Downhole termination 207 provides both physical and optical connections between optical fiber 201 and one or more optical tools or sensors 209. Optical tools or sensors 209 may be the tools or sensors 117 of the coiled tubing operation, may be a component thereof, or provide functionality independent of the tools and sensors 117 that perform the coiled tubing operations. Surface termination 301 and downhole termination 207 are described in greater detail below in conjunction with FIGS. 3 and 4, respectively.

Exemplary optical tools and sensors 209 include temperature sensors and pressure sensors for determining bottom hole temperature or pressure. The optical tool or sensor may also make a measurement of the formation pressure or temperature. In alternative embodiments, optical tool or sensor 209 is a camera operable to provide a visual image of some downhole condition, e.g., sand beds or scale collected on the wall of production tubing, or of some downhole equipment, e.g., equipment to be retrieved during a fishing operation. Tool or sensor 209 may likewise be some form of feeler that can operate to detect or infer physically detectable conditions in the well, e.g., sand beds or scale. Alternatively, tool or sensor 209 comprises a chemical analyzer operable to perform some type of chemical analysis, for example, determining the amount of oil and/or gas in the downhole fluid or measure the pH of the downhole fluid. In such instances, tool or sensor 209 is connected to the fiber optic tether 211 for transmitting the measured properties or conditions to the surface. Thus, where tool or sensor 209 operates to measure a property or condition in the borehole, fiber optic tether 211 provides the conduit to transmit or convey the measured property.

Alternatively tool or sensor 209 is an optically activated tool such as an activated valve or perforation firing-heads. In embodiments comprising perforation firing-heads, firing codes may be transmitted using the optical fiber(s) in fiber optic tether 211. The codes may be transmitted on a single fiber and decoded by the downhole equipment. Alternatively, the fiber optic tether 211 may contain multiple optical fibers with firing-heads connected to a separate fiber unique to that firing-head. Transmitting firing signals over optical fiber 201 of fiber optic tether 211 avoids the deficiencies of cross-talk and pressure-pulse interference that may be encountered when using electrical line or wireline or pressure-pulse telemetry to signal the firing heads. Such deficiencies can lead to firing of the wrong guns or firing at the wrong time.

Figure 2B:
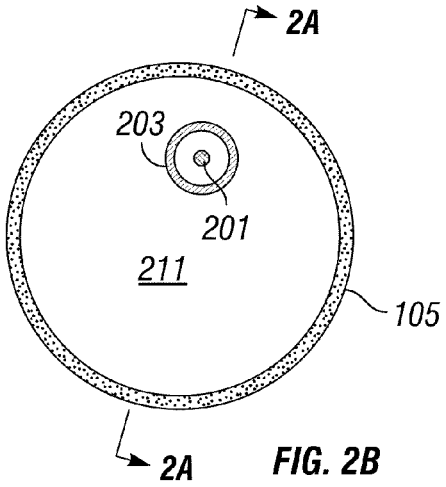
FIG. 2B is a cross-sectional view of the fiber optic coiled tubing apparatus along the line a-a of FIG. 2(*a*).

Turning now to FIG. 2B, there is shown a cross-sectional view of the fiber optic coiled tubing apparatus 200 in which fiber optic tether 211 comprises one or more optical fibers 201 located inside a protective tube 203. The optical fibers may be multi-mode or single-mode. In some embodiments, protective tube 203 comprises a metallic material and in particular embodiments, protective tube 203 is a metal tube comprising Inconel™, stainless steel, Hasetloy™, or another metallic material having suitable tensile properties as well as resistance to corrosion in the presence of acid and $H_2S$.

As way of illustration but not limitation, fiber optic tether 211 has a protective tube 203 with an outer diameter ranging from about 0.071 inches to about 0.125 inches, the protective tube 203 formed around one or more optical fibers 201. In a preferred embodiment, standard optical fibers are used and the protective tube 203 is no more than 0.020 inches thick. It is noted that the inner diameter of protective tube can be larger than needed for a close packing of the optical fibers. In alternative embodiments, fiber optic tether 211 may comprise a cable composed of bare optic fibers or a cable comprising optical fibers coated with a composite material, one example of such composite coated fiber optic cable being Ruggedized Microcable produced by Andrew Corporation, Orland Park, Ill.

Downhole termination 207 may be further connected to one or more tools or sensors 117 for performing operations such as measurement, treatment or intervention in which signals are transmitted between surface control equipment 119 and downhole tools or sensors 117 along fiber optic tether 211. These signals may convey measurements from downhole tools and sensors 117 or convey control signals from the control equipment to downhole tools and sensors 117. In some embodiments, the signals may be conveyed in real time. Examples of such operations include matrix stimulation, fill cleanout, fracturing, scale removal, zonal isolation, coiled tubing conveyed perforation, downhole flow control, downhole completion manipulation, fishing, milling, and coiled tubing drilling.

Fiber optic tether 211 may be deployed into coiled tubing 105 using any suitable means, one of which in particular is using fluid flow. One method to accomplish this it by attaching one end of a short (for example five to fifteen foot long) hose to coiled tubing reel 103 and the other end of the hose to a Y-termination. Fiber optic tether 211 may be introduced into one leg of the Y-termination and fluid pumped into the other one leg of the Y-termination. The drag force of the fluid on the tether then propels the fiber optic tether down the hose and into coiled tubing reel 103. As way of example, when the outer diameter of the fiber optic tether is less than 0.125 inches (0.3175 cm) (and made of Inconel™, a pump rate as low as 1 to 5 barrels per minute (159 to 795 liters/minute) has been shown to be sufficient to propel fiber optic tether 211 along the length of coiled tubing 105 even while it is spooled on the reel. The ease of this operation provides significant benefits over complex methods used in the prior art to place wireline in coiled tubing.

Figure 3A:
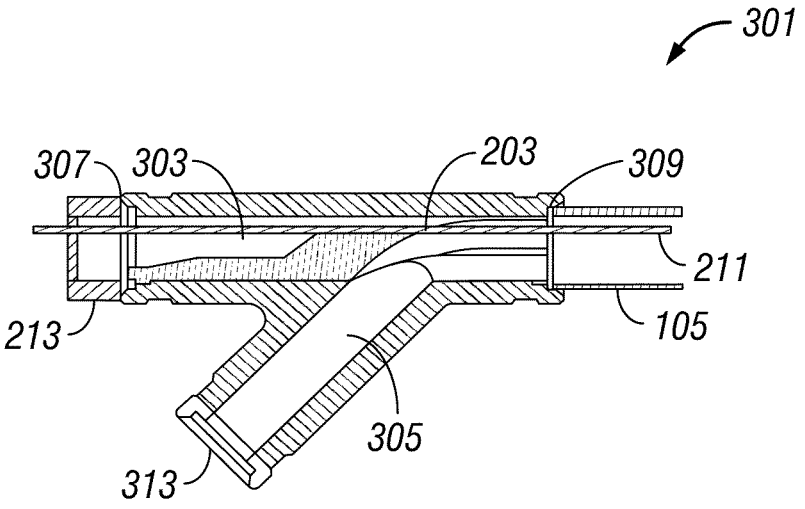
FIG. 3A is a cross-sectional view of a first embodiment of the surface termination of the fiber optic tether according to the invention.
Figure 3B:
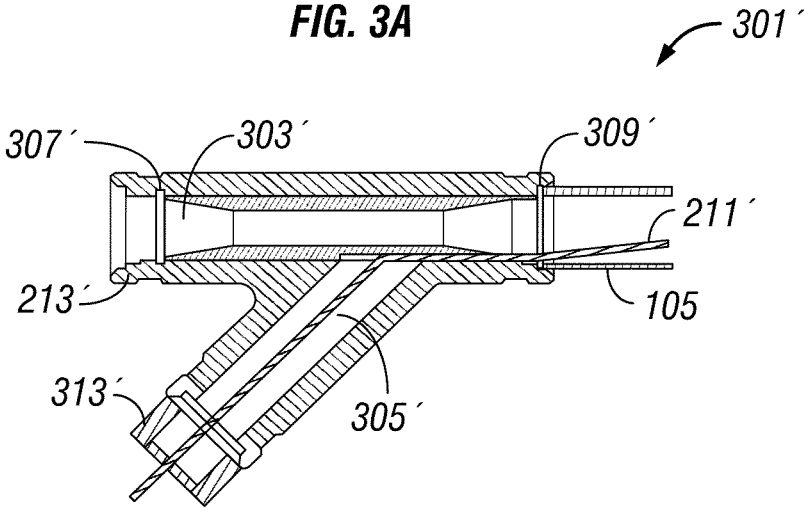
FIG. 3B is a cross-sectional view of a second embodiment of the surface termination of the fiber optic tether according to the invention.
Figure 4:
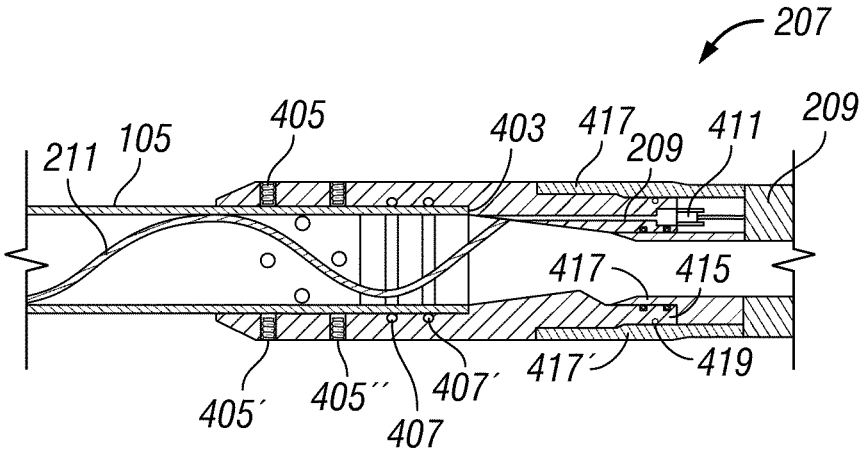
FIG. 4 is a cross-section of the downhole termination of the fiber optic tether.

In practice a sufficient length of fiber optic tether 211 must be provided such that when one end of the tether protrudes through the shaft of the reel, the other end of the tether is still external to the coiled tubing. An additional 10-20% of the fiber optic tether may be needed to allow for slack management as the coiled tubing is spooled into and out of the well bore. Once the desired length of tether has been pumped into the reel, the tether can be cut and the hose disconnected. The tether protruding through the shaft of the reel can be terminated as shown in FIGS. 3A and 3B. The downhole end of the tether can be terminated as shown in FIG. 4.

Referring to FIGS. 3A and 3B, there is shown a cross-sectional view of two alternative embodiments of surface termination 301 of fiber optic tether 211 and surface pressure bulkhead 213. In many applications, it is possible the fiber optic tether 211 may be terminated by routing it around a 90 degree bend of a tee or a connection that is off-axis with respect to fluid flow in the coiled tubing, the tee or connection being preferentially connected to the reel plumbing 123 at the axle of the reel 103. As high pumping rates, balls and abrasive fluids may increase the chance of damaging the installation, it is desirable in some embodiment to provide a surface termination.

FIG. 3A shows a cross-sectional view of a first embodiment of the surface termination of fiber optic tether 211 according to the invention. In the embodiment shown, surface termination 301 comprises a junction having a main leg 303 is on-axis with respect to the coiled tubing 105, and a lateral leg 305 is off-axis with respect to the coiled tubing 105. Fluid flow follows the path defined by the lateral leg 305 and fiber optic tether 211 follows main leg 303. A connection mechanism 313 for introduction of fluids into coiled tubing 105 may be provided at the end of lateral leg 305. Surface termination 301 is connected to coiled tubing 105 or coiled tubing reel plumbing 123 at flange 309 that forms a seal with coiled tubing 105 or coiled tubing reel plumbing 123. Fiber optic tether 211 passes from coiled tubing 105 through surface termination 301 via main leg 303. Surface termination 301 has an uphole flange 307 attached to a pressure bulkhead 213 that permits fiber optic tether 211 to pass through while still maintaining pressure internal to coiled tubing 105. From surface termination 301 fiber optic tether may be connected to control equipment 119, or alternatively to an optical component 505 which allows optical communication to the downhole assembly.

An example of another embodiment of a surface termination of the present invention is shown in FIG. 3B. Surface termination 301' comprises a junction having main leg 303' which is on-axis with respect to coiled tubing 105 and lateral leg 305' which is off-axis with respect to coiled tubing 105. In the embodiment show, fluid flow follows the path defined by main leg 303' and fiber optic tether 211 follows lateral leg 305'. Surface termination 301' may be connected to coiled tubing 105 or to coiled tubing reel plumbing 123 at flange 309', the flange forming a seal with coiled tubing 105 or coiled tubing reel plumbing 123.

Fiber optic tether 211 passes from coiled tubing 105 through the surface termination 301' via lateral leg 303'. Surface termination 301' comprises an uphole flange 307' attached to a pressure bulkhead 213' that permits fiber optic tether 211 to pass through while still maintaining the pressure internal to coiled tubing 105. Main leg 305' may have a connection mechanism 313' provided therewith for introduction of fluids into the coiled tubing 105.

Turning now to FIG. 4, there is shown is a cross-section of one embodiment of a downhole termination 207 for fiber optic tether 211 that provides a controlled penetration of coiled tubing 105 into termination 207. Coiled tubing 105 is attached in the interior of a downhole terminator 207 and seated on mating ledge 403. Coiled tubing 105 may be secured in downhole termination 207 using one or more set-screws 405 and one or more O-rings 407 may be used to seal termination 207 and coiled tubing 105. Fiber optic tether 211 disposed within coiled tubing 105 extends out of coiled tubing 105 and is secured by connector 411. Connector 411 may also provides a connection to tool or sensor 209. The connection formed by connector 411 may be either optical or electrical. For example, if sensor 209 is an optical sensor, the connection is an optical connection. However, in many embodiments tool or sensor 209 is an electrical device, in which case connector 411 also provides any necessary conversion between electrical and optical signals. Tool or sensor 209 may be secured to the terminator, for example, by having downhole end 415 of terminator 207 interposed between two concentric protruding cylinders 417 and 417' and sealed using one or more O-rings 419.

Figure 5A:
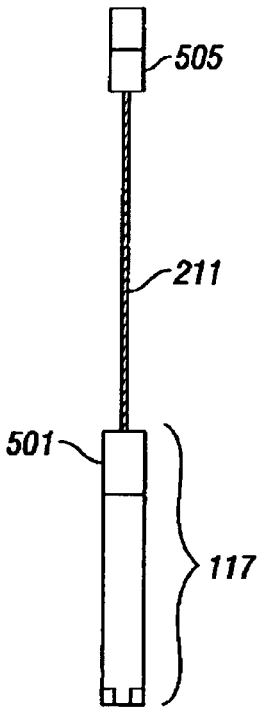
FIG. 5A or 5B are schematic illustrations of a general case of a downhole sensor connected to a fiber optic tether for transmitting an optical signal on the fiber optic tether wherein the optical signal is indicative of the measured property.
Figure 5B:
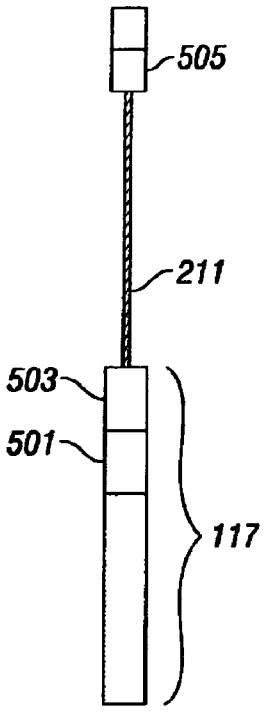

Turning now to FIGS. 5A and 5B, there are shown schematic illustrations of using a downhole optical apparatus 501 connected to a fiber optic tether 211 for transmitting an optical signal, the fiber optic tether 211 being connected at the surface to an optical apparatus 505. This optical apparatus 505 can be attached to the coiled tubing reel 103 and be allowed to rotate with it. In some embodiments, the optical apparatus 505 may comprise a wireless transmitter that also rotates with the reel. Alternatively, optical apparatus 505 may comprise an optical collector having portions that remain stationary while the coiled tubing reel 103 rotates. One example of such an apparatus is a fiber optic rotary joint made by Prizm Advanced Communications Inc. of Baltimore, Md. Downhole optical apparatus 501 contains one or more tools or sensors 209. Tool or sensor 209 may be of two general categories, those that produce an optical signal directly and those that produce an electrical signal that requires conversion into an optical signal for transmission on the fiber optic tether 211.

Several measurements may be made directly based on observed optical properties using known optical sensors.

Examples of such sensors include those of the types described in textbooks such as "*Fiber Optic Sensors and Applications*" by D. A. Krohn, 2000, Instrumentation Systems (ISBN No 1556177143) and include intensity-modulated sensors, phase-modulated sensors, wavelength-modulated sensors, digital switches and counters, displacement sensors, temperature sensors, pressure sensors, flow sensors, level sensors, magnetic and electric field sensors, chemical analysis sensors, rotation rate sensors, gyroscopes, distributed sensing systems, gels, smart skins and structures.

Alternatively, tools or sensors 209 may produce an electrical signal indicative of a measured property. When such electrical signal outputting tools or sensors are used, downhole optical apparatus 501 further comprises an optical-to-electrical interface device 503. Embodiments of optical-to-electrical devices and electrical-to-optical devices are well in the industry. Examples of conversion of conventional sensor data into optical signals are known and described, for example, in "*Photonic Analog-To-Digital Conversion* (*Springer Series in Optical Sciences,* 81)", by B. Shoop, published by Springer-Verlag in 2001. In some embodiments of interface device 503 a simple circuit may be used wherein an electrical signal is used to turn on a light source downhole and the amplitude of that light source is linearly proportional to the amplitude of the electrical signal. An efficient downhole light source for coiled tubing operations is a 1300 nm InGaAsP Light Emitting Diode (LED). The light is propagated along the length of the fiber and its amplitude is detected at surface utilizing a photodiode embedded in the surface apparatus 505. This amplitude value can then be passed to the control equipment 119. In another embodiment, an analog to digital converter is used in interface devices 503 to analyze the electrical signal from the sensor 209 and convert them to digital signals. The digital representation may then be transmitted to surface along the fiber optic tether 211 in digital form or converted back to an analog optical signal by varying the amplitude or frequency. Protocols for transmission of digital data on optical fibers are extremely well known in the art and not repeated here. Another embodiment of interface device 503 may convert the signal from sensor 209 into an optical feature that can be interrogated from the surface, for example, it could be a change of reflectivity at the end of the optical fiber, or a change in the resonance of a cavity. It should be noted that in some embodiments, the optical-to-electrical interface and the measuring device may be integrated into one physical device and handled as one unit.

In various embodiments, the present invention provides a method of determining a wellbore property comprising the steps of deploying a fiber optic tether into a coiled tubing, deploying a measurement tool into a wellbore on the coiled tubing, measuring a property using the measurement tool, and using the fiber optic tether to convey the measured property. Such properties may include for example pressure, temperature, casing collar location, resistivity, chemical composition, flow, tool position, state or orientation, solids bed height, precipitate formation, gas such as carbon dioxide and oxygen measurement, pH, salinity, and fluid compressibility.

Knowledge of the bottom hole pressure is useful in many operations using coiled tubing. In some embodiments, the present invention provides a method for an operator to optimize pressure-dependent parameters of the wellbore operation. Suitable optical pressure sensors are known, such as those for example that use the Fiber Bragg Grating technique and the Fabry-Perot technique. The Fiber Bragg Grating technique relies upon a grating on a small section of the fiber that locally modulates the index of refraction of the fiber core itself at a specific spacing. The section is then constrained to respond to a physical stimulus such as pressure, temperature or strain. The interrogation unit is placed at the other end of the fiber and launches a broadband light source down the length of the fiber. The wavelength corresponding to the grating period is reflected back toward the interrogation unit and detected. As the physical stimulus changes, the period of the grating changes; consequently the reflected wavelength changes which is then correlated to the physical property being observed, resulting in the measurement. The Fiber Bragg Grating technique offers the advantage of permitting multiple measurements along a single fiber. In embodiments of the present invention that utilize Fiber Bragg Grating, the interrogation unit may be placed in the surface optical apparatus 505.

Sensors that use the Fabry-Perot technique contain a small optical cavity constrained to respond to a physical stimulus such as pressure, temperature, length or strain. The initial surface of the cavity is the fiber itself with a partially reflective coating and the opposing surface is a typically a fully reflective mirror. An interrogation unit is placed at one end of the fiber and used to launch a broadband light source down the fiber. At the sensor, an interference pattern is created that is unique to the specific cavity length, so the wavelength of the peak intensity reflected back to the surface corresponds to length of the cavity. The reflected signal is analyzed at the interrogation unit to determine the wavelength of the peak intensity, which is then correlated to the physical property being observed resulting in the measurement. One limitation of the Fabry-Perot technique is that one optical fiber is required for each measurement taken. However, in some embodiments of the present invention, multiple optical fibers may be provided within fiber optic tether 211, which permits use of multiple Fabry-Perot sensors in downhole apparatus 501. One such pressure sensor that uses the Fabry-Perot technique and which is suitable for use in coiled tubing applications is manufactured by FISO Technologies, St-Jean-Baptiste Avenue, Montreal, Canada.

Temperature measurements may also be made by measuring strain by Fiber Bragg Grating or Fabry-Perot techniques along the optical fiber of the fiber optic tether 211 and converting from strain on the fiber induced by thermal expansion of a component attached to the fiber to temperature. In some embodiments, a sensor may be used to make a localized measurement and in some embodiments a measurement the complete temperature distribution along the length of the tether 211 can also be made. To achieve temperature measurements, pulses of light at a fixed wavelength may be transmitted from a light source in the surface equipment 505 down a fiber optic line. At every measurement point in the line, light is back scattered and returns to the surface equipment. Knowing the speed of light and the moment of arrival of the return signal enables its point of origin along the fiber line to be determined. Temperature stimulates the energy levels of the silica molecules in the fiber line. The back-scattered light contains upshifted and downshifted wavebands (such as the Stokes Raman and Anti-Stokes Raman portions of the back-scattered spectrum), which can be analyzed to determine the temperature at origin. In this way the temperature of each of the responding measurement points in the fiber line can be calculated by the equipment, thereby providing a complete temperature profile along the length of the fiber line. This general fiber optic distributed temperature system and technique is well known in the prior art. As is further known in the art, the fiber optic line may also return to the surface line so that the entire line has a U-shape. Using a return line may provide enhanced performance and increased spatial resolution because errors due to end-effects are moved far away from the zone of interest. In one embodiment of this invention, the downhole apparatus 501 consists of a small U-shaped section of fiber. The downhole termination 207 provides two coupling connections between two optical fibers within the tether to both halves of the U-shape, so that the assembled apparatus becomes a single optical path with a return line to the surface. In another embodiment of this invention, the downhole apparatus 501 contains a device to enter a particular branch of a multilateral well, so that the temperature profile of a particular branch can be transmitted to the surface. Such profiles can then be used to identify water zones or oil-gas interfaces from each leg of the multilateral well. Apparatus for orienting a downhole tool and entering a particular lateral is known in the art.

Some coiled tubing operations benefit from the measurements of differential temperature along the borehole or a section of the borehole, as described by V. Jee, et al, in U.S. Patent Publication US 2004/0129418, the entire disclosure of which is incorporated herein by reference. However, for other operations the temperature at a particular location is of interest, e.g., the bottom hole temperature. For such operations, it is not necessary to obtain a complete temperature profile along the length of a fiber optic line. Single point temperature sensors have an advantage with respect to distributed temperature measurements in that the latter requires averaging of signals over a time interval to discard noise. This can introduce a small delay to the operation. When fluid breakers need to be changed (or the formation is no longer taking proppant) then immediacy of information is of paramount importance. A single temperature sensor or pressure sensor near the bottom-hole assembly on the coil tubing provides a mechanism for transmitting this important data to surface sufficiently fast to permit control decisions in regard to the job.

In many coiled tubing applications, it is desirable to know the location in the wellbore relative to installed casing; a casing collar locator that observes a property signature indicative of the presence of a casing collar typically is used for such locating purposes. A conventional casing collar locator has a solenoidal coil wound axially around the tool in which a voltage is generated in the coil in the presence of a changing electrical or magnetic field. Such a change is encountered when moving the downhole tool across a part of the casing that has a change in material properties such as a mechanical joint between two lengths of casing. Perforations and sliding sleeves in the casing can also create signature voltages on the solenoidal coil. Casing collar locators do not have to be actively powered, as is described, for example, in U.S. Pat. No. 2,558,427, incorporated herein by reference. In some embodiments of the present invention, a traditional casing collar locator may be connected to the fiber optic tether 211 via an electrical-to-optical interface 503 using a light emitting diode. To detect the location of casing collars in a wellbore, the casing collar locator may be connected to the coiled tubing and conveyed across a length of the wellbore. As the coiled tubing is moved, a signal is generated when a change in electrical or magnetic field is detected such as encountered at a casing collar and that signal is transmitted using the fiber optic tether 211. Other methods of determining depth include measuring a property of the wellbore and correlating that property against a measurement of that same property that was obtained on an earlier run. For example, during drilling it is common to make a measurement of the natural gamma rays emitted by the formation at each point along the wellbore. By providing a measurement of gamma ray via an optical line, the location of the depth of the coiled tubing can be obtained by correlating that gamma ray against the earlier measurement.

Measurements of flow in the wellbore often are desired in coiled tubing operations and embodiments of the present invention are useful to provide this information. Measurements of flow in the wellbore outside of coiled tubing may be used to determine flow rates of the wellbore fluid into the formation such as a treatment rate or flow rates of formation fluids into the wellbore such as production rate or differential production rate. Measurements of flow in the coiled tubing may be useful to measure fluid delivery into different zones in the wellbore or to measure the quality and consistency of foam in foamed treatment fluids. Known methods for measuring flow in a wellbore may be adapted for use in the present invention. In some embodiments, a flow-measuring device, such as spinner, may be connected to fiber optic tether 211. As flow passes the device, the flow-measuring device measures the flow rate and that measurement is transmitted via the fiber optic tether 211. In embodiments in which a conventional flow-measuring device that outputs an electrical signal may be used, an electrical-to-optical interface 503 is provided to convert the electrical signals to optical signals for transmission on fiber optic tether 211. A flow-measuring device that measuring flow spinner by a direct optical technique, for example by placing a blade of the spinner in between a light source and a photodetector such that the light will be alternately blocked and cleared as the spinner rotates, may be used in some embodiments. Alternatively, flow-measurement devices that use indirect optical techniques may be used in some embodiments of the present invention. Such indirect optical techniques rely upon how the flow rate affects an optical device such that a change in optical properties of that device may be observed may be used in some embodiments of the present invention.

Often in coiled tubing operations is it desirable to have information relating to the position or orientation of a tool or apparatus in the wellbore. Furthermore it is desired in coiled tubing operations to determine the state of a tool or apparatus (e.g. open or closed, engaged or disengaged) of a tool or apparatus in a wellbore. Wellbore trajectory may be inferred from spot measurements of tool orientation or may be determined from continuous monitoring of orientation as a tool is moved along a wellbore. Orientation is useful in determining location of a tool in a multi-lateral well as each branch has a known azimuth or inclination against which the orientation of the tool may be compared. Typically orientation of a tool in a wellbore is measured using a gyroscope, an inertial sensor, or an accelerometer. For example, see U.S. Pat. No. 6,419,014, incorporated herein by reference. Such devices in fiber optic enabled configurations are known. Fiber optic gyroscopes, for example, are available from a number of vendors such as Exalos, based in Zurich, Switzerland. In some embodiments of the present invention, sensor 209 is a device for determining tool position or orientation, which is useful for determining wellbore trajectory. This positioning or orientation device may be connected to the fiber optic tether 211, measurements taken indicative of position or orientation in the wellbore, and those measurements transmitted on fiber optic tether 211 in various embodiments of the present invention. In alternative embodiments, sensor 209 may be a traditional or MEMS gyroscopic device coupled to fiber optic tether 211 via an electrical-to-optical interface 503.

Use of such positioning or orientation devices particularly is useful in multi-lateral wellbores. In some embodiments of the present invention, an apparatus for entering a particular branch of a multi-lateral wellbore branch, such is that described in U.S. Pat. No. 6,349,768 incorporated herein in the entirety by reference, may be used in conjunction with a positioning or orientating device to firstly determine whether the tool or apparatus is at the entry point of a branch in a multi-lateral wellbore and then to enter the branch. In this way the coiled tubing may be positioned in a desired location within the wellbore or the bottom-hole assembly may be orientated in a desired configuration. Additionally, a mechanical or optical switch may be used to determine position or state of such a bottom-hole assembly.

In some coiled tubing operations, information relating to solids in the wellbore, such as solids bed height or precipitate formation is desired. In some embodiments of the present invention, sensor 209 is useful to measure solids or detect precipitate formation during well operations. Such measurements may be transmitted via fiber optic tether 211. The measurements may be used to adjust a parameter, such as fluid pump rate or rate of moving the coiled tubing, to improve or optimize the coiled tubing operation. In some embodiments of the present invention, a proximity sensor, including a conventional proximity sensor with an optical interface, or a caliper may be used to determine the location and height of a solids bed in a well. Known proximity sensors use nuclear, ultrasonic or electromagnetic methods to detect the distance between the bottom hole assembly and the interior of the casing wall. Such sensors may also be used to warn of an impending screenout in wellbore operation such as fracturing. Detecting precipitate formation is useful in wellbore operations is useful for monitoring the progress of well treatments performed during coiled tubing operations, for example, matrix stimulation. In some embodiments of the present invention, sensor 209 is a device for detecting precipitate formation using methods known such as a direct optical measurement of reflectance and scattering amplitude.

In wellbore operations in general, measurements of properties such as resistivity may be used as an indicator of the presence of hydrocarbons or other fluids in the formation. In some embodiments of the present invention, a tool or sensor 209 may be used to measure resistivity using conventional techniques and be interfaced with fiber optic tether 211 through an electrical-to-optics interface whereby resistivity measurements are transmitted on the fiber optic tether. Alternatively, resistivity may be measured indirectly by measuring the salinity or refractive index using optical techniques, with the optical changes due to resistivity being then transmitted to the surface on fiber optic tether 211. In various embodiments, the present invention is useful to provide resistivity monitoring of the formation, formation fluid, treatment fluid, or fluid-solid-gas products or byproducts.

In wellbore application, chemical analysis to some degree may be determined by downhole sensor such as luminescence sensors, fluorescence sensors or a combination of these with resistivity sensors. Luminescence sensors and fluorescence sensors are known as well as optical techniques for analyzing their output. One manner of accomplishing this is a reflectance measurement. Utilizing a fiber optic probe, light is shown into the fluid and a portion of the light is reflected back into the probe and correlated to the existence of gas in the fluid. A combination of fluorescence and reflectance measurement may be used to determine the oil and gas content of the fluid. In some embodiments of the present invention, sensor 209 is a luminescence or fluorescence sensor the output from which is transmitted via fiber optic tether 211. In particular embodiments in which more the one optical fiber is provided within fiber optic tether 211, more than one sensor 209 may transmit information on separate ones of the optical fibers.

The presence of detection gases such as $CO_2$ and $O_2$ in the wellbore may also be measured optically. Sensors capable of measuring such gases are known; see for example "*Fiber Optic Fluorosensor for Oxygen and Carbon Dioxide", Anal. Chem.* 60, 2028-2030 (1988) by O. S. Wolfbeis, L. Weis, M. J. P. Leiner and W. E. Ziegler, incorporated herein by reference. As described therein, the capability of fiber-optic light guides to transmit a variety of optical signals simultaneously can be used to construct an optical fiber sensor for measurement of oxygen and carbon dioxide. An oxygen-sensitive material (e.g., a silica gel-absorbed fluorescent metal-organic complex) and a $CO_2$-sensitive material (e.g., an immobilized pH indicator in a buffer solution) may be placed in a gas-permeable polymer matrix attached to the distal end of an optical fiber. Although both indicators may have the same excitation wavelength (in order to avoid energy transfer), they have quite different emission maxima. Thus the two emission bands may be separated with the help of interference filters to provide independent signals. Typically oxygen may be determined in the 0 to 200 Torr range with ±1 Torr accuracy and carbon dioxide may be determined in the 0-150 Torr range with ±1 Torr. Thus, in various embodiments of the present invention, sensor 209 may be an optical device detecting $CO_2$ or $O_2$ from which a measurement is transmitted via fiber optic tether 211.

Measurement of pH is useful in many coiled tubing operations as the behavior of treatment chemicals can depend highly upon pH. Measurement of pH measurement is also useful to determine precipitation in fluids. Fiber optic sensors for measuring pH sensor are known. One such sensor described by M. H. Maher and M. R Shahriari in the Journal of Testing and Evaluation, Vol 21, Issue 5 in Sep. 1993, is a sensor constructed out of a porous polymeric film immobilized with pH indicator, housed in a porous probe. The optical spectral characteristics of this sensor showed very good sensitivity to changes in the pH levels tested with visible light (380 to 780 nm). Sol gel probes can also be used to measure specific chemical content as well as pH. Alternatively a sensor may measures pH by measuring the optical spectrum of a dye that has been injected into fluid, whereby that dye has been chosen so that its spectral properties change dependent upon the pH of the fluid. Such dyes are similar, in effect, to litmus paper, and are well known in the industry. For example, The Science Company of Denver, Colo. sells a number of dyes that change color according to narrow changes in pH. The dye may be inserted into the fluid through the lateral leg 305 at the surface. In various embodiments of the present invention, a sensor 209 is a pH sensor connected to fiber optic tether 211 such that measurements from the sensor may be transmitted via the fiber optic tether.

It is noted that the sensing of changes in pH changes is one example of how the present invention may be used to monitor changes in wellbore fluids. It is fully contemplated within the present invention that sensors useful to measure changes in chemical, biological or physical parameters may be used as sensor 209 from which a measurement of a property or a measurement of a change in property may be transmitted via fiber optic tether 211.

For example, salinity of the wellbore fluid or a pumped fluid may be measured or monitored using embodiments of the present invention. One method useful in the present invention is to send a light signal done the optical fiber and sense the beam deviation caused by the optical refraction at the receiving end face due to the salinity of brine. The measured optical signals are reflected and transmitted through a sequentially linear arranged fibers array, and then the light intensity peak value and its deviant are detected by a charge-coupled device. In such a configuration, the sensor probe may be composed of an intrinsically pure GaAs single crystal a right angle prism, a partitioned water cell, the emitting fiber with an attached self-focused lens and the linear arranged receiving fibers array. An alternative method for measuring salinity changes has been proposed by O. Esteban, M. Cruz-Navarrete, N. lez-Cano, and E. Bernabeu in "*Measurement of the Degree of Salinity of Water with a Fiber-Optic Sensor*", Applied Optics, Volume 38, Issue 25, 5267-5271 Sep. 1999, incorporated by reference. The method described uses a fiber-optic sensor based on surface-plasmon resonance for the determination of the refractive index and hence the degree of salinity of water. The transducing element consists of a multilayer structure deposited on a side-polished monomode optical fiber. Measuring the attenuation of the power transmitted by the fiber shows that a linear relation with the refractive index of the outer medium of the structure is obtained. The system is characterized by use of a varying refractive index obtained with a mixture of water and ethylene glycol.

Embodiments of the present invention are useful to measure fluid compressibility when sensor 209 is an apparatus such as that described in U.S. Pat. No. 6,474,152, incorporated herein in the entirety by reference, to measure fluid compressibility and the measurement transmitted via fiber optic tether 211. Such measurements avoid the necessity of measuring volumetric compression and are particularly suited for coiled tubing applications. In measuring fluid compressibility, the change in the optical absorption at certain wavelengths resulting from a change in pressure correlates directly with the compressibility of fluid. In other words, the application of a pressure change to hydrocarbon fluid changes the amount of light absorbed by the fluid at certain wavelengths, which can be used as a direct indication of the compressibility of the fluid.

In various embodiments, the present invention provides a method of performing an operation in a subterranean wellbore comprising deploying a fiber optic tether into a coiled tubing, deploying the coiled tubing into the wellbore and performing at least one of the following steps: transmitting control signals from a control system over the fiber optic tether to borehole equipment connected to the coiled tubing; transmitting information from borehole equipment to a control system over the fiber optic tether; or transmitting a property measured by the fiber optic tether to a control system via the fiber optic tether. In some embodiments, the present invention provides a method of working in a wellbore comprising deploying a fiber optic tether into a coiled tubing, deploying the coiled tubing into the well; and performing an operation; wherein the operation is controlled by signals transmitted over the fiber optic tether. Such operations may include for example activating valves, setting tools, activating firing heads or perforating guns, activating tools, and reversing valves. Such examples are given as way of examples not as limitations.

In some embodiments of the invention, downhole devices such as tools may be optically controlled via signals transmitted on fiber optic tether 211. Similarly information relating to the downhole device, such as a tool setting, may be transmitted on fiber optic tether 211. In some embodiments wherein fiber optic tether 211 comprises more than one optical fiber, at least one of the optical fibers may be dedicated for tool communications. If desired, more than one downhole device may be provided and a separate optical fiber may be dedicated for each device. In other embodiments wherein a single optical fiber is provided in fiber optic tether 211, this communication may be multiplexed such that the same fiber may also be used to convey sensed information. In the event that multiple tools are present, the multiplexing scheme, such as the number of pulses in a given time, the length of a constant pulse, the intensity of incident light, the wavelength of incident light, and binary commands may be extended to include the additional tools.

In some embodiments of the present invention, a downhole device such as a valve activation mechanism is provided in conjunction with a fiber optic interface to form a fiber optic enabled valve. The fiber optic interface is connected to the fiber optic tether 211 such that control signals may be transmitted to the device via fiber optic tether 211. One embodiment of a fiber optic interface may consist of an optical-to-electrical interface board together with a small battery to convert the optical signal into a small electrical signal that drives a solenoid that in turn actuates the valve.

Typically in coiled tubing operations, downhole tools are configured at the surface before being deployed into the wellbore. There are occasions however when it would be desirable to set or to adjust a setting of a tool downhole. In some embodiments of the invention, a downhole tool is equipped with an optical-to-electrical interface for receiving optical signals and translating the optical signals to electrical or digital signals. The optical-to-electrical interface is further connected to logic on the downhole tool for downloading and possibly storing into memory thereto parameters for the tool or sensor. Thus, a fiber optic enabled coiled tubing operation with a tool that is equipped to receive tool parameters on the fiber optic tether 211 provides the operator the ability to adjust tool settings downhole in real time.

One example is the adjustment of the gain of fiber optic casing collar circuitry. In this instance, one gain setting may be desired for tripping operations at speeds of 50 to 100 feet per minute (0.254 to 0.508 m/sec), and another gain setting may be desired for logging or perforating operations at speeds of 10 feet per minute (0.0508 m/sec) or less. A control signal from surface equipment may be transmitted to the casing collar locator via fiber optic tether 211. Such functionality is useful as different gain settings be desired based on the specific metallurgy of the casing. This metallurgy may not be known in advance and as a result, it may be desirable to send a control signal from surface equipment to the casing collar locator via fiber optic tether 211 to adjust the gain setting in real time in response to a measurement made by the casing collar locator and transmitted to the surface equipment via fiber optic tether 211.

In other embodiments, the present invention provides a method to activate perforating guns or firing heads downhole by transmitting a control signal from surface equipment to the downhole device. A fiber optic interface may be used with a firing head is activated using electrical signals, the fiber optic interface converting the optical signal transmitted on fiber optic tether 211 to an electrical signal for activating the firing head. A small battery may be used to power the interface. More than one firing head may be used. In embodiments in which fiber optic tether 211 comprises more than one optical fiber, each head can be assigned to a unique fiber. Alternatively, when a single optical fiber is provided, a unique coded sequence may be used to provide discrete signals to various ones of the firing heads. Use of optical fiber to transmit such control signals is advantageous as it minimizes the possibility of accidental firing of the wrong head owing to electromagnetic cross talk such as may be experienced with wireline cable. Alternatively, a light source from the surface may be used to activate an explosive firing head directly. In certain embodiments, the firing head may be activated using optical control circuitry such as that described in U.S. Pat. No. 4,859,054, incorporated herein by reference.

In coiled tubing operations, it is often necessary to activate tools in the wellbore. The tool actuation can take a variety of forms such as, including but not limited to, release of stored energy, shifting of a safety or lockout, actuation of a clutch, actuation of a valve, actuation of a firing head for perforating. Such activation typically is controlled or verified using rudimentary telemetry consisting of pressure, flow rate and push/pull forces, which are susceptible to well influences, and often may be ineffective. For example, push/pull forces exerted at surface are reduced by friction with the wellbore, the amount of friction being unknown. When using pressure communication, the signal often is masked by friction pressure associated with circulating fluids through the coiled tubing and flow within the wellbore. Flow rate typically is a better means of communication; however, some tools require configuration that lead to unknown fluid leakoff that may affect the flow rate indicator. In some embodiments of the invention, tool activation signals are transmitted to the tool over the fiber optic tether 211. In some cases, the tool may be equipped with an optical-to-electrical interface that may have an amplification circuitry and operable to receive an optical signal and convert it to an electrical signal to which the tool activation circuitry responds while in other cases, the tool may be suited to receive the optical signal directly.

In one embodiment of the invention an optically controlled reversing valve is connected to the fiber optic tether. A signal may be sent to the reversing valve from surface control equipment 119 via fiber optic tether 211 to disable the check valves, for example to allow reverse circulation of fluids (i.e. from the annulus into the coiled tubing) under certain conditions. In response to this signal, the valve shifts from the disabled position to activate the check valves. In an embodiment, fiber optic activation of the reversing valve may further provide a signal from the valve to the surface equipment to indicate the status of the valve.

In various embodiments, the present invention provides a method of treating a subterranean formation intersected by a wellbore, the method comprising deploying a fiber optic tether into a coiled tubing, deploying the coiled tubing into the wellbore, performing a well treatment operation, measuring a property in the wellbore, and using the fiber optic tether to convey the measured property. Fiber-optic enabled coiled tubing apparatus 200 may be used to perform well treatment, well intervention and well services and permits operations hitherto not possible using conventional coiled tubing apparatus. Note that a key advantage of the present invention is that the fiber optic tether 211 does not impede the use of the coiled tubing string for well treatment operations. Furthermore, as many well treatment operations require moving the coiled tubing in the wellbore, for example to "wash" acid along the inside of that wellbore, an advantage of the present invention is that it is suited for use as coiled tubing is in motion in the wellbore.

Matrix stimulation is a well treatment operation wherein a fluid, typically acidic, is injected into the formation via a pumping operation. Coiled tubing is useful in matrix stimulation as it permits focused injection of treatment into a desired zone. Matrix stimulation may involve the injection of multiple injection fluids into a formation. In many applications, a first preflush fluid is pumped to clear away material that could cause precipitation and then a second fluid is pumped once the near wellbore zone is cleared. Alternatively, a matrix stimulation operation may entail injection of a mixture of fluids and solid chemicals.

Figure 6:
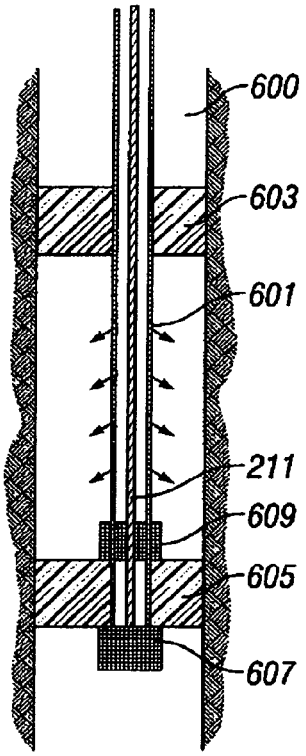
FIG. 6 is a schematic illustration of well treatment performed using a coiled tubing apparatus having a fiber optic tether according to the invention.

Referring to FIG. 6, there is shown a schematic illustration of matrix stimulation performed using a coiled tubing apparatus comprising a fiber optic tether according to the invention wherein a well treatment fluid is introduced into a wellbore 600 through coiled tubing 601. The treatment fluid may be introduced using one of the various tools known in the art for that purpose, e.g., nozzles attached to the coiled tubing. In the example of FIG. 6, the fluid that is introduced into the wellbore 600 is prevented from escaping from the treatment zone by the barriers 603 and 605. The barriers 603 and 605 may be some mechanical barrier such as an inflatable packer or a chemical division such as a pad or a foam barrier.

It is preferred in matrix stimulation operations to place the treatment fluid in the proper zone(s) in the wellbore 600. In a preferred embodiment, an optical sensor 607 capable of determining depth may be used to determine the location of the downhole apparatus providing the matrix stimulation fluid. Optical sensor 607 is connected to fiber optic tether 211 for communicating the location in the wellbore 600 to the surface control equipment to allow an operator to activate the introduction of the treatment fluid at the optimal location.

The present invention permits real time monitoring of parameters such bottom-hole pressure, bottom-hole temperature, bottom-hole pH, amount of precipitate being formed by the interaction of the treatment fluids and the formation, and fluid temperature, each of which are useful for monitoring the success of a matrix stimulation operation. A sensor 609 for measuring such parameters (e.g., a sensor for measuring pressure, temperature, or pH or for detecting precipitate formation) may be connected to fiber optic tether 211 disposed within coiled tubing 601 and to the fiber optic tether 211. The measurements may then be communicated to the surface equipment over fiber optic tether 211.

Real-time measurement of bottomhole pressure, for example, is useful to monitor and evaluate the formation skin, thereby permitting optimization of the injection rate of stimulation fluid, or permitting the concentration or relative proportions of mixing fluid or relative proportions of mixing fluids and solid chemicals to be adjusted. When the coiled tubing is in motion, measurements of real-time bottom-hole pressure may be adjusted by subtracting off swab and surge effects to take into account the motion of the coiled tubing. Another use of real-time bottom hole pressure is to maintain borehole pressure from fluid pumping below a desired threshold level. During matrix stimulation for example, it is important to contact the wellbore surface with treatment fluid. If the wellbore pressure is too high, then formation will fracture and the treatment fluid will undesirably flow into the fracture. The ability to measure bottom hole pressure in real time particularly is useful when treatment fluids are foamed. When pumping non-foamed fluids, bottom hole pressure sometimes may be determined from surface measurements by assuming certain formulas for friction loss down the wellbore, but such methods are not well established for use with foamed fluids.

Measurements of bottomhole parameters other than pressure also are useful in well treatment operations. Real-time bottomhole temperature measurements may be used to calculate foam quality and is therefore useful in ensuring an effective employment of a diversion technique. Bottomhole temperature similarly may be used in determining progress of the stimulation operation and is therefore useful in adjusting concentration or relative proportions of mixing fluids and solid chemicals. Measurement of bottom-hole pH is useful for the purpose of selecting an optimal concentration of treatment fluids or the relative proportions of each fluid pumped or relative proportions of mixing fluids and solid chemicals. Measurement of precipitate formed by the interaction of fluids with wall of the wellbore may also be employed to analyze whether to adjust the concentration or mixture of the treatment fluid, e.g., relative concentrations or relative proportions of mixing fluids and solid chemicals.

In an alternative use of the coiled tubing apparatus 200 in which a multiplicity of fluids are injected into the formation, in part through the coiled tubing and in part through the annulus formed between the coiled tubing 105 and the wall of wellbore 121, the coiled tubing 105 forms a mechanical barrier to isolate the fluids injected through the coiled tubing 105 from fluids injected into the annulus. Measurements such as bottom hole temperature and bottom hole pressure taken in real-time and transmitted to the surface on the fiber optic tether 211 may be used to adjust the relative proportions of the fluids injected through the coiled tubing 105 and the fluids injected in the annulus.

In one alternative in which the coiled tubing 105 acts as a barrier between fluids in the coiled tubing 105 and in the annulus, the fluids injected through the coiled tubing 105 are foamed or aerated. When released down-hole at the end of the coiled tubing 105 the foamed fluids partially fill the annular space around the base of the coiled tubing thereby creating an interface in the annulus between the fluids pumped down the coiled tubing and the fluids pumped down the annulus. Various parameters of the stimulation operation including the relative proportions of fluids pumped in the annulus and in the coiled tubing, and the position of the coiled tubing may be adjusted to ensure that that interface is positioned at a particular desired position in the reservoir or may be used to adjust the location of the interface. Adjusting the particular position of the interface is useful to ensure that the stimulation fluids enter the zone of interest in the reservoir either to enhance the flow of hydrocarbon from the reservoir or to impede flow from a non-hydrocarbon bearing zone. To enhance hydrocarbon flow and to impede non-hydrocarbon flow a diverting fluid such as that described in U.S. Pat. No. 6,667,280, incorporated herein in the entirety by reference may be pumped down the coiled tubing.

In some matrix stimulation operations, it may be desired to pump a catalyst down coiled tubing 105 to convey the catalyst to a particular position in the wellbore. Physical properties such as bottom hole temperature, bottom hole pressure, and bottomhole pH that are measured and transmitted to the surface in real-time on the fiber optic tether 211 may be used to monitor the progress of the matrix stimulation process and consequently used to adjust the concentration of catalyst to influence that progress. In some embodiment of the invention, matrix stimulation operations fiber optic tether 211 may be used to provide a distributed temperature profile, such as that described in U.S. Patent Publication 2004/0129418.

In another well treatment operation, the fiber optic enabled coiled tubing apparatus 200 of the present invention is employed in a fracturing operation. Fracturing through coiled tubing is a stimulation treatment in which a slurry or acid is injected under pressure into the formation. Fracturing operations benefit from the capabilities of the present invention in using a fiber optic tether 211 to transmit data in real-time in several ways. Firstly, real-time information such as bottomhole pressure and temperature is useful to monitor the progress of the treatment in the wellbore and to optimize the fracturing fluid mixture. Often fracturing fluids, and in particular polymer fracturing fluids, require a breaker additive to breaks the polymer. The time required to break the polymer is related to the temperature, exposure time and breaker concentration. Consequently, knowledge of the downhole temperature allows the breaker schedule to be optimized to break the fluid as it enters the formation or immediately thereafter, thereby reducing the contact of the polymer and the formation. The inclusion of polymer enhances the fluid's ability to carry the proppant (e.g., sand) used in the fracturing operation.

In addition, pressure sensors may be deployed on the coiled tubing to permit characterization of fracture propagation. A Nolte-Smith plot is log-log plot of pressure versus time used in the industry to evaluate the treatment propagation. The inability of the formation to accept any more sand can be detected by a rise in the slope of log (pressure) versus log (time). Given that information in real time using the present invention, it would be possible to adjust the rate and concentration of the fluid/proppant at the surface and to manipulate the coiled tubing so as to activate a downhole valve mechanism to flush the proppant out of the coiled tubing. One such downhole valve mechanism is described in U.S. Patent Publication 2004/0084190, incorporated herein in the entirety by reference. A downhole pressure sensor may be connected to fiber optic tether 211 such that pressure measurements may be transmitted to the surface equipment to provide information at the surface regarding the wellbore treatment. Additionally, measurements from downhole pressure sensors connected to fiber optic tether 211 may be used to identify the onset of a treatment screenout where a subterranean formation under treatment will no longer accept the treatment fluid. This condition is typically preceded by a gradual increase in pressure on the Nolte-Smith plot, such a gradual rise typically not being identifiable using surface-based pressure measurement only. Consequently, the present invention provides useful information to identify the gradual rise in pressure enables the operator to be able to adjust the treatment parameters such as rate and sand concentration to avoid or minimize the affect of the screenout condition.

In general, proper placement of treatment fluids in particular subterranean formations is important. In one alternative embodiment of the invention, sensor 607 is a sensor operable to determine the location of the coiled tubing equipment in the well 600 and further operable to transmit requisite data indicating location on the fiber optic tether 211. The sensor may be, for example, a casing collar locator (CCL). By transmitting in real-time to the surface control unit 119, the depth of the coiled tubing, conveyed fracturing tools to the surface equipment, it is possible to ensure that the fracturing depth corresponds to the desired zone or the perforated interval.

Fill cleanout is another wellbore operation for which coiled tubing often is employed. The present invention provides advantageous in fill cleanout by providing information such as fill bed height and sand concentration at the wash nozzle in real-time over the fiber optic tether 211. According to an embodiment of the invention, the operation can be enhanced by providing a downhole measurement of the compression of the coiled tubing, because this compression will increase as the end of the coiled tubing pushes further into a hard fill. According to some embodiments of the present invention, a downhole sensor operable measures fluid properties and wellbore parameters that affect fluid properties and to communicate those properties to the surface equipment over fiber optic tether 211. Fluid properties and associated parameters that are desirable to measure during fill cleanout operations include but are not limited to viscosity and temperature. Monitoring of these properties may be used to optimize the chemistry or mixing of the fluids used in the fill cleanout operation. According to yet another embodiment of the invention, the optically enabled coiled tubing system, 200, may be used to provide cleanout parameters such as those described in U.S. Patent Application "Apparatus and Methods for Measurement of Solids in a Wellbore" by Rolovic et al., U.S. patent application Ser. No. 11/010,116 the entire contents of which are incorporated herein by reference.

Figure 7:
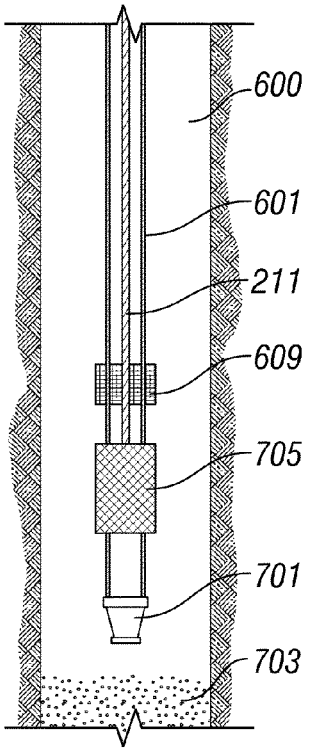
FIG. 7 is a schematic illustration of a fill clean-out operation enhanced by employing a fiber optic enabled coiled tubing string according to the invention.

Turning now to FIG. 7, there is shown a schematic illustration of a fill out operation enhanced by employing a fiber optic enabled coiled tubing string according to the invention. The coiled tubing 601 may be used to convey a washing fluid into the well 600 and applied to fill 703. The downhole end of the coiled tubing may be supplied with some form of nozzle 701. A sensor 705 is connected to the fiber optic tether 211. The sensor 705 may measure any of various properties that can be useful in fill clean-out operations including compression on the coil, pressure, temperature, viscosity, and density. The properties are then conveyed up the fiber optic tether 211 to the surface equipment for further analysis and possible optimization of the cleanout process.

In an alternative embodiment, the nozzle 701 may be equipped with multiple controllable ports. During clean out operations the nozzle may become clogged or obstructed. By selectively opening the multiple controllable ports, the nozzle may be cleaned by selectively flushing the controllable ports. For such operations, the fiber optic tether is employed to convey control signals from the surface equipment to the nozzle 701 to instruct the nozzle to selectively flush one or more of the controllable ports. The optical signal may activate the controllable ports using an electric actuator, operated with battery power, for activating each controllable port, the optical signal being used to control the electric actuator. Alternatively, the actuators may be fire-by-light valves wherein the optical power sent through the fiber powers the valve to cause a resultant action, in particular, to selectively open or close one or more of the controllable ports.

In some embodiments of the present invention, tools or sensor 607 of the fiber optic enabled coiled tubing apparatus 200 may comprise a camera or feeler arrangement used for scale removal. Scale may become deposited inside the production tubing and then acts as a restriction thereby reducing the capacity of the well and/or increasing the lifting costs. The camera or feeler arrangement connected to fiber optic tether 211 may be used to detect the presence of scale in the production tube. Either photographic images, in the case of a camera, or data indicative of the presence of scale, in the case of the feeler arrangement, may be transmitted on fiber optic tether 211 from the downhole camera or feeler arrangement to the surface where it may be analyzed.

In another alternative the tools or sensor 607 may comprise a fiber optic controlled valve. The fiber optic controlled valve is connected to the fiber optic tether 211 and in response to control signals from surface equipment, the valve may be used to the mixture or release of chemicals to remove or inhibit scale deposition.

In coiled tubing operations, such as for example stimulation, water control, and testing, it is often desirable to isolate a particular open zone in the wellbore to ensures that all pumped or produced fluid comes from the isolated zone of interest. In an embodiment of the invention, the fiber optic enabled coiled tubing apparatus 200 is employed to actuate the zonal control equipment. The fiber optic tether 211 permits the operator using the surface equipment to control the zonal isolation equipment more precisely than what is possible using the prior art push-pull and hydraulic commands. The zonal isolation operations may also benefit from real-time availability of pressure, temperature and location (e.g., from a CCL).

By employing fiber optic communication, along the fiber optic tether 211, zonal isolation operations and measurements are much improved because the communication system does not interfere with the use of the coil to pump fluids. Furthermore, by reducing the amount of pumping required, operators using the fiber optic communication for zonal isolation as described herein can expect cost and time savings.

Embodiments of the present invention are useful in perforating using coiled tubing. When perforating, it is crucial to have good depth control. Depth control in coiled tubing operations can be difficult however due to the residual bend and torturous path the coiled tubing takes in the wellbore. In prior art coiled tubing conveyed perforation operations, the depth at which hydraulically actuated firing heads are fired is controlled by a series of memory runs used in conjunction with a stretch predicting program or a separate measuring device. The memory approach is both costly and time consuming, and using a separate device can add time and expense to a job.

Figure 8:
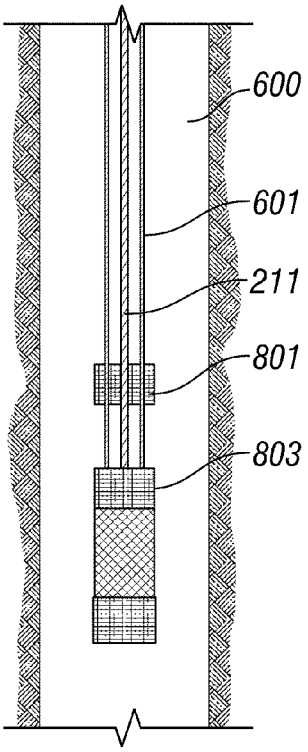
FIG. 8 is a schematic illustration of a coiled tubing conveyed perforation system according to the invention, wherein a fiber optic enabled coiled tubing apparatus is adapted to perform perforation.

Shown in FIG. 8 is a schematic illustration of a coiled tubing conveyed perforation system according to the present invention, wherein a fiber optic enabled coiled tubing apparatus 200 is adapted to perform perforation. A casing collar locator 801 is attached to coiled tubing 601 and connected to fiber optic tether 211. Also attached to the coiled tubing is a perforating tool 803, e.g., a firing head. Casing collar locator 801 transmits signals indicative of the location of a casing collar on the fiber optic tether to the surface equipment. Perforating tool 803 may also be connected to the fiber optic tether 211, either directly or indirectly, whereby it may be activated by transmitting optical signals from surface equipment on the fiber optic tether 211 when at the desired depth as measured by the casing collar locator.

Figure 9:
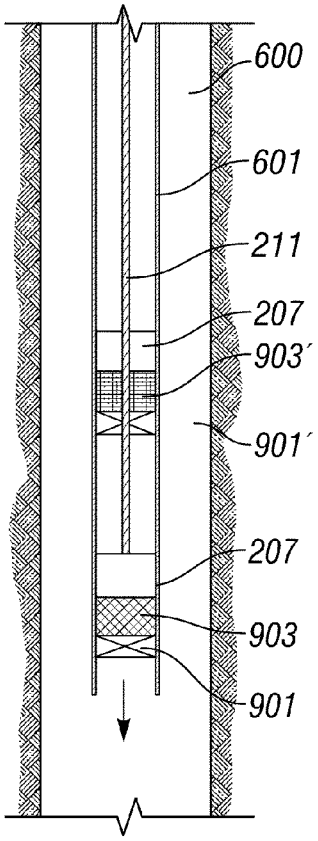
FIG. 9 is an exemplary illustration of downhole flow control in which a fiber-optic control valve is used to control the flow of borehole and reservoir fluids.

Referring to FIG. 9, there is shown an exemplary illustration of downhole flow control in which a fiber-optic control valve 901 or 901' may be used to control the flow of borehole and reservoir fluids. For example, a control-valve 901 may be used to either direct fluid pumped down the coil into the reservoir or a control-valve 901' may be used to direct fluid flow back up the annulus surrounding the coiled-tubing 601. This technique is often referred to as "spotting" and is useful in situations where an appropriate volume of that fluid stimulates the reservoir, but too much of that fluid would in fact then harm the production coming from the subterranean formation. In some embodiments, the present invention comprises a specific mechanism to control the flow involves a light-sensitive detection, coupled with an amplifying circuit 903 or 903' to take the light signal and turn the detection of light into an electrical voltage or current source, which in turn drives an actuator of the valve 901 or 901'. A small power source may be used to drive the electrical amplifying circuit 903 or 903'.

One common coiled tubing operation is in use to manipulate a downhole completion accessory such as a sliding sleeve. Typically this is accomplished by running a specially designed tool that latches with the completion component and then the coiled tubing is manipulated resulting in the manipulation of the completion component. The present invention is useful to permit selective manipulation of components or to permit more than one manipulation in a single trip. For example, if the operator required that the well be cleaned and have the completion component actuated, the fiber optic tether 211 could be used to send control signals for the control system 119 to selectively shift between the cleanout configuration and the manipulation configuration. Similarly the present invention may be used to verify the status or location of equipment in a wellbore while performing an unrelated intervention.

Another wellbore operation in which coiled tubing is employed is fishing equipment lost in well bores. Fishing typically requires a specially sized grapple or spear to latch the uppermost component remaining in the wellbore, that uppermost component being referred to as a fish. In some embodiments, the tool or sensor 209 is a sensor connected to the fiber optic tether and operable to verify that the fish is latched in the retrieval tool. The sensor is, for example, a mechanical or an electrical device that senses a proper latching of the fish. The sensor is connected to an optic interface for converting the detection of a properly latched fish in to an optical signal transmitted to the surface equipment on the fiber optic tether 211. In another embodiment, the tool or sensor 209 may be an imaging device (e.g., a camera such as is available from DHV International of Oxnard, Calif.) connected to the fiber optic tether and operable to accurately determine the size and shape of the fish. Images obtained by the imaging device are transmitted to the surface equipment on fiber optic tether 211. In other embodiments, an adjustable retrieval tool may be connected to the fiber optic tether 211 so that the retrieval tool may be controlled from surface equipment by transmission of optical signals on the fiber optic tether 211, thus allowing the number of required retrieval tools to be dramatically reduced. In this embodiment, the tool or sensor 209 is an optically activated device similar to the optically activated valves and ports discussed herein above.

In some embodiments, the present invention relates to a method of logging a wellbore or determining a property in a wellbore comprising deploying a fiber optic tether into a coiled tubing, deploying a measurement tool into a wellbore on the coiled tubing, measuring a property using the measurement tool, and using the fiber optic tether to convey the measured property. The coiled tubing and measurement tool may be retracted from the wellbore and measurements may be made while retracting, or measurements may be made concurrently with the performance of a well treatment operation. Measured properties may be conveyed to surface equipment in real time.

In wireline logging, one or more electrical sensors (e.g., one that measures formation resistivity) are combined into a tool known as a sonde. The sonde is lowered into the borehole on an electrical cable and subsequently withdrawn from the borehole while measurements are being collected. The electrical cable is used both to provide power to the sonde and for data telemetry of collected data. Well-logging measurements have also been made using coiled tubing apparatus in which an electric cable has been installed into the coiled tubing. A fiber-optic enabled coiled tubing apparatus according to the present invention has the advantage of that the fiber-optic tether 211 is more easily deployed in a coiled tubing than is an electric line. In a well-logging application of the fiber-optic coiled tubing apparatus, the tools or sensors 209 is a measuring device for measuring a physical property in the well bore or the rock surrounding the reservoir. In applications where tool or sensor 209 requires power for logging or measurement, such power may be provided using a battery pack or turbine. In some applications, however, this means that the size and complexity of the surface power supply can be reduced.

Although specific embodiments of the invention has been described and illustrated, the invention is not to be limited to the specific forms or arrangements of parts so described and illustrated. Numerous variations and modifications will become apparent to those skilled in the art once the above disclosure is fully appreciated. It is intended that the present invention be interpreted to embrace all such variations and modifications.

We claim:

1. A method of performing a wellbore operation in a subterranean wellbore of a subterranean formation comprising:

deploying a coiled tubing and an optical fiber tether into the wellbore, the optical fiber tether disposed in a fluid flow path of the coiled tubing, wherein the optical fiber tether defines a small cross-sectional area configured not to impede the fluid flow path of the coiled tubing, thereby not interfering with the use of the coiled tubing for pumping fluids in well treatment operations, the optical fiber configured to make a distributed range of measurements across an interval of the wellbore;

performing the wellbore operation, the wellbore operation comprising the use of a well treatment fluid flowing from a surface of the wellbore along the fluid flow path of the coiled tubing and passing the well treatment fluid out of the coiled tubing for contact with and treatment of the subterranean formation;

obtaining a measured property related to the wellbore operation;

sending the measured property to a control system over the optical fiber;

adjusting the wellbore operation based on the measured property; and removing the coiled tubing and optical fiber tether from the wellbore after completing the wellbore operation.

2. The method of claim 1, wherein the wellbore operation is a stimulation operation for stimulating a flow of hydrocarbons from the wellbore.

3. The method of claim 2, wherein the stimulation operation comprises injecting at least one fluid into a formation adjacent the wellbore.

4. The method of claim 3, wherein the stimulation operation is a matrix stimulation operation and wherein the at least one fluid comprises an acidic fluid.

5. The method of claim 3, wherein the stimulation operation is a matrix stimulation operation and wherein the at least one fluid comprises a mixture of a fluid and a solid chemical.

6. The method of claim 1, wherein the wellbore operation is a clean out operation for removing debris from the wellbore.

7. The method of claim 1, wherein the wellbore operation is chosen from the group consisting of cleaning fill, stimulating the reservoir, removing scale, and fracturing.

8. The method of claim 1, wherein the wellbore operation is chosen from the group consisting of matrix stimulation, perforation, downhole flow control, downhole completion manipulation, well logging, fishing, measuring a physical property of the wellbore, controlling a valve, and controlling a tool.

9. The method of claim 1, wherein wellbore operation is chosen from the group consisting of circulating the well, isolating zones, fishing for lost equipment, placement of equipment in the wellbore, manipulation of equipment in the wellbore, locating a piece of equipment in the well, locating a particular feature in a wellbore.

10. The method of claim 1, wherein the wellbore operation comprises injecting a fluid into the wellbore and wherein adjusting the wellbore operation comprises adjusting one of a quantity of the injected fluid, a concentration of catalyst to be released, a concentration of a polymer, and a concentration of a proppant.

11. The method of claim 1, wherein the wellbore operation comprises injecting a set of fluids into the wellbore and wherein adjusting the wellbore operation comprises adjusting one of a relative proportion of each fluid in the set of fluids, a chemical concentration of one or more of the set of fluids, a relative proportion of a fluid being pumped through the coiled tubing to a fluid being pumped in an annulus between the wellbore and an outer surface of the coiled tubing.

12. The method of claim 1, wherein the measured property comprises a distributed range of measurements across an interval of the wellbore, wherein the distributed measurements are made by the fiber optic tether.

13. The method of claim 1, wherein the measured property comprises a property chosen from the group consisting of pressure, temperature, pH, amount of precipitate, fluid temperature, wellbore depth, presence of a gas, chemical luminescence, gamma-ray, resistivity, salinity, fluid flow, fluid compressibility, tool location, presence of a casing collar locator, tool state and tool orientation.

14. The method of claim 1, further comprising connecting a tool to the coiled tubing and wherein the measured property comprises a property chosen from the group consisting of tool depth in the wellbore, presence of a casing collar locator, tool state and tool orientation.

15. The method of claim 1, wherein the measured property comprises a property chosen from the group consisting of a bottomhole pressure, a bottomhole temperature, a distributed temperature, compression, tension, torque, tool position, gamma-ray, tool orientation, solids bed height, and casing collar location.

16. The method of claim 1, wherein the optical fiber tether seals the optical fiber from fluid flow.

17. The method of claim 1 wherein an outer diameter of the optical fiber tether comprises about 0.071 inches to about 0.125 inches.

18. A method of performing an operation in a subterranean wellbore of a subterranean formation comprising:

deploying an optical fiber assembly, a coiled tubing, a borehole tool and a sensor into the wellbore, the optical fiber assembly comprising at least a fiber optic tether disposed in a fluid flow path of the coiled tubing and defining an outer diameter selected not to impede fluid flow within the fluid flow path of the coiled tubing, the fiber optic tether configured to make a distributed range of measurements across an interval of the wellbore;

optically connecting the optical fiber assembly to the borehole tool and the sensor;

performing the operation in the wellbore by flowing a well treatment fluid from a surface of the wellbore along the fluid flow path of the coiled tubing and passing the well treatment fluid out of the coiled tubing for contact with and treatment of the subterranean formation;

operating the sensor to obtain a measured property related to the operation;

measuring a property related to the operation with the optical fiber assembly;

sending the measured properties to a control system over the optical fiber assembly;

transmitting control signals from the control system to the borehole tool over the optical fiber assembly to adjust the operation based on the measured property; and removing the optical fiber assembly, the coiled tubing, the borehole tool, and the sensor from the wellbore after completing the operation.

19. The method of claim 18, wherein the optical fiber tether seals the optical fiber from fluid flow.

20. The method of claim 18 wherein the outer diameter of the fiber optic tether comprises about 0.071 inches to about 0.125 inches.

21. An apparatus for performing an operation in a wellbore of a subterranean formation, comprising:

coiled tubing adapted to be disposed in a wellbore;

surface control equipment;

a borehole tool connected to the coiled tubing and comprising a measurement device for measuring a property related to the operation; and an optical fiber tether assembly installed in a fluid flow path of the coiled tubing configured to provide distributed measurements across an interval of the borehole and optically connected to each of the borehole tool, the measurement device and the surface control equipment, the optical fiber tether assembly comprising a first optical fiber for transmission of signals from the measurement device to the surface control equipment, and a second optical fiber for transmission of signals from the surface control equipment to the borehole tool to adjust the operation based on a property measured by the measurement device or on the distributed measurements from the optical fiber tether assembly, wherein the coiled tubing is adapted to be disposed in the wellbore to perform the operation and removed from the wellbore after completing the operation, the optical fiber tether assembly comprising a metal tube surrounding the optical fibers such that the optical fiber tether assembly defines a small outer diameter configured not to impede fluid flow in the fluid flow path and thereby enable the use of the fluid flow path of the coiled tubing for well treatment operations, the well treatment operations comprising the use of a well treatment fluid flowing from a surface of the wellbore along the fluid flow path of the coiled tubing and passing the well treatment fluid out of the coiled tubing for contact with and treatment of the subterranean formation, wherein an outer diameter of the optical fiber tether assembly comprises about 0.071 inches to about 0.125 inches.

22. The apparatus of claim 21, wherein the optical fiber assembly seals the optical fibers from fluid flow.

* * * * *